US010805708B2

(12) United States Patent
Mou

(10) Patent No.: US 10,805,708 B2
(45) Date of Patent: Oct. 13, 2020

(54) HEADSET SOUND CHANNEL CONTROL METHOD AND SYSTEM, AND RELATED DEVICE

(71) Applicant: Huawei Technologies Co., Ltd., Shenzhen (CN)

(72) Inventor: Lei Mou, Nanjing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 66 days.

(21) Appl. No.: 16/095,547

(22) PCT Filed: Apr. 20, 2016

(86) PCT No.: PCT/CN2016/079736
§ 371 (c)(1),
(2) Date: Oct. 22, 2018

(87) PCT Pub. No.: WO2017/181365
PCT Pub. Date: Oct. 26, 2017

(65) Prior Publication Data
US 2019/0132666 A1 May 2, 2019

(51) Int. Cl.
*H04R 1/10* (2006.01)
*H04R 5/033* (2006.01)
*H04R 5/04* (2006.01)

(52) U.S. Cl.
CPC ..... *H04R 1/1041* (2013.01); *H04R 5/033* (2013.01); *H04R 5/04* (2013.01); *H04R 2420/07* (2013.01)

(58) Field of Classification Search
CPC ..... H04R 1/1041; H04R 5/033; H04R 5/04; H04R 2420/07
(Continued)

(56) References Cited

U.S. PATENT DOCUMENTS 5,959,597 A * 9/1999 Yamada ..... G02B 27/017 345/8
8,787,602 B2 * 7/2014 Macours ..... H04R 5/04 381/300
(Continued)

FOREIGN PATENT DOCUMENTS

CN 201349247 Y 11/2009
CN 101998222 A 3/2011
(Continued)

OTHER PUBLICATIONS

Machine Translation and Abstract of Chinese Publication No. CN104202697, Dec. 10, 2014, 13 pages.
(Continued)

*Primary Examiner* — Xu Mei
(74) *Attorney, Agent, or Firm* — Conley Rose, P.C.

(57) ABSTRACT

A terminal, headset, and system, where the headset is configured to determine a wearing mode of the headset, generate a wearing mode signal according to the wearing mode of the headset, and send the wearing mode signal to the terminal, the terminal is configured to receive the wearing mode signal, and control, according to the wearing mode signal, sound channel output of an audio signal played by the terminal. In this manner, when the headset is reversely worn, the terminal may automatically perform headset sound channel switching. Hence, a user can implement sound channel switching without transposing left and right earpieces of the headset, thereby improving headset sound channel switching efficiency.

20 Claims, 11 Drawing Sheets

(58) Field of Classification Search
USPC ..... 381/74, 26, 309, 384; 455/575.2
See application file for complete search history.

(56) References Cited

U.S. PATENT DOCUMENTS

| | | | | |
|---|---|---|---|---|
| 9,002,025 | B2 * | 4/2015 | Marten | H04R 1/1041 379/428.02 |
| 9,681,219 | B2 * | 6/2017 | Vilermo | H04R 1/32 |
| 10,448,140 | B2 * | 10/2019 | Kumar | G10K 11/178 |
| 2009/0154720 | A1 * | 6/2009 | Oki | H04R 1/1041 381/74 |
| 2009/0245549 | A1 * | 10/2009 | Jubelirer | H04R 1/1091 381/309 |
| 2011/0038484 | A1 | 2/2011 | Macours | |
| 2012/0243704 | A1 * | 9/2012 | Sorensen | H04R 1/1041 381/74 |
| 2014/0079238 | A1 | 3/2014 | Bastide et al. | |
| 2016/0259618 | A1 * | 9/2016 | Rekimoto | H04R 1/1041 |
| 2017/0105071 | A1 | 4/2017 | Xu | |
| 2017/0208394 | A1 | 7/2017 | Xu et al. | |
| 2018/0014104 | A1 * | 1/2018 | Boesen | H04R 1/1025 |
| 2018/0115815 | A1 * | 4/2018 | Kumar | H04R 29/001 |

FOREIGN PATENT DOCUMENTS

| | | | |
|---|---|---|---|
| CN | 102026082 | A | 4/2011 |
| CN | 202103814 | U | 1/2012 |
| CN | 103929698 | A | 7/2014 |
| CN | 104080028 | A | 10/2014 |
| CN | 104125522 | A | 10/2014 |
| CN | 104202697 | A | 12/2014 |
| CN | 104469624 | A | 3/2015 |
| CN | 105101016 | A | 11/2015 |
| EP | 1850628 | A1 | 10/2007 |

OTHER PUBLICATIONS

Machine Translation and Abstract of Chinese Publication No. CN104469624, Mar. 25, 2015, 13 pages.
Machine Translation and Abstract of Chinese Publication No. CN202103814, Jan. 4, 2012, 6 pages.
Foreign Communication From a Counterpart Application, Chinese Application No. 201680084443.0, Chinese Office Action dated Jun. 19, 2019, 10 pages.
Machine Translation and Abstract of Chinese Publication No. CN102026082, Apr. 20, 2011, 10 pages.
Machine Translation and Abstract of Chinese Publication No. CN104080028, Oct. 1, 2014, 24 pages.
Machine Translation and Abstract of Chinese Publication No. CN105101016, Nov. 25, 2015, 25 pages.
Foreign Communication From a Counterpart Application, PCT Application No. PCT/CN2016/079736, English Translation of International Search Report dated Jan. 4, 2017, 2 pages.
Foreign Communication From a Counterpart Application, PCT Application No. PCT/CN2016/079736, English Translation of Written Opinion dated Jan. 4, 2017, 5 pages.
Machine Translation and Abstract of Chinese Publication No. CN201349247, Nov. 18, 2009, 13 pages.

* cited by examiner

HEADSET SOUND CHANNEL CONTROL METHOD AND SYSTEM, AND RELATED DEVICE

CROSS-REFERENCE TO RELATED APPLICATIONS

This application is a U.S. National Stage of International Patent Application No. PCT/CN2016/079736 filed on Apr. 20, 2016, which is hereby incorporated by reference in its entirety.

TECHNICAL FIELD

Embodiments of the present invention relate to the field of communications technologies, and specifically, to a headset sound channel control method and system, and a related device.

BACKGROUND

Currently, a headset generally has an audio-left channel and an audio-right channel, and most headsets feature fixed sound channel output. For example, a left earpiece of a headset is corresponding to audio-left channel output, and a right earpiece of the headset is corresponding to audio-right channel output. When a user uses a headset to listen to music and watch a video, to obtain better auditory experience, a left earpiece of the headset is usually worn on a left ear, and a right earpiece of the headset is usually worn on a right ear. Once the left and right earpieces of the headset are reversely worn, when an actor on the left is talking in a video that the user is watching, sound heard by the right ear of the user may be slightly louder than sound heard by the left ear. Consequently, an auditory effect is affected. In this case, the user usually performs sound channel switching by transposing wearing positions of the headset earpieces. However, efficiency of this switching manner is relatively low.

SUMMARY

Embodiments of the present invention disclose a headset sound channel control method and system, and a related device, so as to resolve a problem that headset sound channel switching efficiency is relatively low.

A first aspect of the embodiments of the present invention discloses a headset sound channel control method. The method is applied to a terminal, the terminal and a headset establish a communication connection, and the method may include:

after receiving, by using the pre-established communication connection, a wearing mode signal sent by the headset, the terminal may control, according to the wearing mode signal, sound channel output of an audio signal played by the terminal, where the wearing mode signal is used to indicate that the headset is reversely worn or the headset is correctly worn.

In this manner, the terminal may control a sound channel output manner of left and right earpieces of the headset according to a wearing mode (a reverse wearing mode or a correct wearing mode) of the headset. That is, the terminal may automatically control sound channel output of the left and right earpieces of the headset when the headset is reversely worn, and a user does not need to transpose wearing positions of the headset earpieces, so that headset sound channel switching efficiency can be improved.

In another implementation, that the terminal receives, by using the communication connection, a wearing mode signal sent by the headset may include:

when the communication connection is a wired connection, and the wired connection includes an audio input channel (a communications line that can transmit a sound signal collected by a microphone) between the headset and the terminal, the terminal receives, by using the audio input channel, the wearing mode signal sent by the headset, where the wearing mode signal is a carrier signal; the carrier signal may be a specified carrier signal, such as a modulated carrier in a specified frequency or a carrier signal in a specified waveform; and the carrier signal may be used to indicate at least one of the following: the headset is reversely worn or the headset is correctly worn.

In still another implementation, that the terminal controls, according to the wearing mode signal, sound channel output of an audio signal played by the terminal specifically includes:

the terminal parses the wearing mode signal to obtain a parsing result, so that the terminal can control, according to the parsing result, the sound channel output of the audio signal played by the terminal.

In still another implementation, that the terminal parses the wearing mode signal to obtain a parsing result may include:

the terminal compares the carrier signal with a carrier signal that is used to indicate a wearing mode of the headset, where the carrier signal that is used to indicate the wearing mode of the headset includes a carrier signal that is used to indicate that the headset is reversely worn and a carrier signal that is used to indicate that the headset is correctly worn; and if the carrier signal matches the carrier signal that is used to indicate that the headset is reversely worn, the terminal determines that the headset is reversely worn; or if the carrier signal matches the carrier signal that is used to indicate that the headset is correctly worn, the terminal determines that the headset is correctly worn.

In still another implementation, that the terminal receives, by using the communication connection, a wearing mode signal sent by the headset includes:

when the communication connection is a wireless connection (for example, a Bluetooth connection), the terminal receives, by using the wireless connection, the wearing mode signal sent by the headset, where the wearing mode signal is an extended code.

In still another implementation, that the terminal parses the wearing mode signal to obtain a parsing result may include:

the terminal compares the extended code with an extended code that is used to indicate a wearing mode of the headset, where the extended code that is used to indicate the wearing mode of the headset includes an extended code that is used to indicate that the headset is reversely worn and an extended code that is used to indicate that the headset is correctly worn; and if the extended code matches the extended code that is used to indicate that the headset is reversely worn, the terminal determines that the headset is reversely worn; or if the extended code matches the extended code that is used to indicate that the headset is correctly worn, the terminal determines that the headset is correctly worn.

In still another implementation, when the wearing mode signal is used to indicate that the headset is reversely worn, and the headset determines that a distance between the headset and an obstacle falls beyond a preset distance threshold, the wearing mode signal is sent by the headset to the terminal by using the communication connection, so that the terminal outputs, by means of sound channel switching according to the wearing mode signal, the audio signal played by the terminal.

In still another implementation, the terminal may further detect whether an application program running in a foreground is an application program that has an audio output function, such as a music player, a video player, or a game application. If the application program running in the foreground is the application program that has an audio output function, the terminal outputs, by means of sound channel switching according to the wearing mode signal, the audio signal played by the terminal.

The terminal performs headset sound channel switching only when the headset is reversely worn and the application program running in the foreground is the application program that has an audio output function. This can avoid unnecessary sound channel switching, and improve sound channel switching accuracy.

In still another implementation, the terminal may further generate and output prompt information according to the wearing mode signal, so as to notify a user that the headset is reversely worn and whether sound channel switching is to be performed; and receive a sound channel control instruction selected by the user according to the prompt information. The sound channel control instruction is used to instruct to perform sound channel switching or maintain current sound channel output. If the sound channel control instruction is used to instruct to perform sound channel switching, the terminal outputs, by means of sound channel switching according to the wearing mode signal, the audio signal played by the terminal.

The prompt information may be a voice prompt or a text prompt. The terminal may output the prompt information by using the headset, may output the prompt information on a screen of the terminal, or may output the prompt information by using a wearable device.

After receiving the wearing mode signal that is used to indicate that the headset is reversely worn, the terminal may prompt the user to determine whether to perform automatic sound channel switching or manual switching, thereby improving sound channel switching flexibility.

A second aspect of the embodiments of the present invention discloses another headset sound channel control method. The method is applied to a headset, the headset and a terminal pre-establish a communication connection, and the method may include:

determining, by the headset, a wearing mode of the headset, generating a wearing mode signal according to the wearing mode of the headset, and sending the wearing mode signal to the terminal by using the communication connection, where the wearing mode includes a reverse headset wearing mode and a correct headset wearing mode, and the wearing mode signal is used to indicate that the headset is reversely worn or the headset is correctly worn, so that the terminal can control, according to the wearing mode signal, sound channel output of an audio signal played by the terminal.

The headset may determine the wearing mode of the headset, and generate the wearing mode signal according to a result of the determining, so as to notify the terminal of a wearing status of the headset, so that the terminal can control the sound channel output of the played audio signal according to the wearing mode signal. That is, the terminal may automatically control sound channel output of left and right earpieces of the headset when the headset is reversely worn, and a user does not need to transpose wearing positions of the headset earpieces, so that headset sound channel switching efficiency can be improved.

In another implementation, the determining, by the headset, a wearing mode of the headset specifically includes:

detecting whether the headset is in a wearing state; when the headset is in a wearing state, detecting a distance between the headset and an obstacle, and determining whether the distance falls within a preset distance threshold; and if the distance falls beyond the preset distance threshold, determining that the wearing mode of the headset is the reverse headset wearing mode; or if the distance falls within the preset distance threshold, determining that the wearing mode of the headset is the correct headset wearing mode.

In still another implementation, the sending, by the headset, the wearing mode signal to the terminal by using the communication connection may include:

when the communication connection is a wired connection, and the wired connection includes an audio input channel between the headset and the terminal, sending, by the headset, the wearing mode signal to the terminal by using the audio input channel, where the wearing mode signal is a carrier signal; the carrier signal may be a specified carrier signal, such as a modulated carrier in a specified frequency or a carrier signal in a specified waveform; and the carrier signal may be used to indicate at least one of the following: the headset is reversely worn or the headset is correctly worn; or when the communication connection is a wireless connection (for example, a Bluetooth connection), sending, by the headset, the wearing mode signal to the terminal by using the wireless connection, where the wearing mode signal is an extended code.

A third aspect of the embodiments of the present invention discloses a terminal. The terminal and a headset pre-establish a communication connection, and the terminal may include a communications module and a control module.

The communications module is configured to receive, by using the communication connection established between the terminal and the headset, a wearing mode signal sent by the headset, where the wearing mode signal is used to indicate that the headset is reversely worn or the headset is correctly worn.

The control module is configured to control, according to the wearing mode signal, sound channel output of an audio signal played by the terminal.

In this manner, the terminal may control a sound channel output manner of left and right earpieces of the headset according to a wearing mode (a reverse wearing mode or a correct wearing mode) of the headset. That is, the terminal may automatically control sound channel output of the left and right earpieces of the headset when the headset is reversely worn, and a user does not need to transpose wearing positions of the headset earpieces, so that headset sound channel switching efficiency can be improved.

In another implementation, a specific manner in which the communications module receives, by using the communication connection established between the terminal and the headset, the wearing mode signal sent by the headset may include:

when the communication connection is a wired connection, and the wired connection includes an audio input channel (a communications line that can transmit a sound signal collected by a microphone) between the headset and the terminal, receiving, by using the audio input channel, the wearing mode signal sent by the headset, where the wearing mode signal is a carrier signal; the carrier signal may be a specified carrier signal, such as a modulated carrier in a specified frequency or a carrier signal in a specified waveform; and the carrier signal may be used to indicate at least one of the following: the headset is reversely worn or the headset is correctly worn.

In still another implementation, the terminal may further include a parsing module.

The parsing module is configured to: parse the wearing mode signal received by the communications module, to obtain a parsing result, and send the parsing result to the control module, so that the control module can control, according to the parsing result, the sound channel output of the audio signal played by the terminal.

In still another implementation, a specific manner in which the parsing module parses the wearing mode signal to obtain the parsing result may include:

comparing the carrier signal with a carrier signal that is used to indicate a wearing mode of the headset, where the carrier signal that is used to indicate the wearing mode of the headset includes a carrier signal that is used to indicate that the headset is reversely worn and a carrier signal that is used to indicate that the headset is correctly worn; and if the carrier signal matches the carrier signal that is used to indicate that the headset is reversely worn, determining that the headset is reversely worn; or if the carrier signal matches the carrier signal that is used to indicate that the headset is correctly worn, determining that the headset is correctly worn.

In still another implementation, a specific manner in which the communications module receives, by using the communication connection established between the terminal and the headset, the wearing mode signal sent by the headset may include:

when the communication connection is a wireless connection (for example, a Bluetooth connection), receiving, by using the wireless connection, the wearing mode signal sent by the headset, where the wearing mode signal is an extended code.

In still another implementation, a specific manner in which the parsing module parses the wearing mode signal to obtain the parsing result may include:

comparing the extended code with an extended code that is used to indicate a wearing mode of the headset, where the extended code that is used to indicate the wearing mode of the headset includes an extended code that is used to indicate that the headset is reversely worn and an extended code that is used to indicate that the headset is correctly worn; and if the extended code matches the extended code that is used to indicate that the headset is reversely worn, determining that the headset is reversely worn; or if the extended code matches the extended code that is used to indicate that the headset is correctly worn, determining that the headset is correctly worn.

In still another implementation, the terminal may further include:

a generation module, configured to generate, according to the parsing result, prompt information that is used to indicate whether sound channel switching is to be performed;

an output module, configured to output the prompt information, where the prompt information may be a voice prompt or a text prompt; and an input module, configured to: after the output module outputs the prompt information, receive a sound channel control instruction entered by a user according to the prompt information, where the sound channel control instruction is used to instruct to perform sound channel switching or maintain current sound channel output.

When the sound channel control instruction is used to instruct to perform sound channel switching, the control module outputs, by means of sound channel switching according to the sound channel control instruction, the audio signal played by the terminal.

After receiving the wearing mode signal that is used to indicate that the headset is reversely worn, the terminal may prompt the user to determine whether to perform automatic sound channel switching or manual switching, thereby improving sound channel switching flexibility.

A fourth aspect of the embodiments of the present invention discloses another terminal. The terminal includes a processor, a communications interface, a microphone chip, an input device, an output device, a memory, and the like. The communications interface is configured to receive and send data, or the like. The processor is mainly configured to process the data. The microphone chip is configured to parse a carrier signal. The output device may be configured to output prompt information to a user. The input device may be configured to receive a sound channel control instruction entered by the user. The memory may store an operating system, computer code, data, and the like that are to be used by the terminal.

A fifth aspect of the embodiments of the present invention discloses a headset. The headset and a terminal pre-establish a communication connection, and the headset may include:

a determining module, configured to determine a wearing mode of the headset, where the wearing mode includes a reverse headset wearing mode and a correct headset wearing mode;

a generation module, configured to generate a wearing mode signal according to the wearing mode that is of the headset and that is determined by the determining module, where the wearing mode signal is used to indicate that the headset is reversely worn or the headset is correctly worn; and a communications module, configured to send the wearing mode signal to the terminal by using the communication connection, so that the terminal can control sound channel output of a played audio signal according to the wearing mode signal.

The headset may determine the wearing mode of the headset, and generate the wearing mode signal, so as to notify the terminal of a wearing status of the headset, so that the terminal can control, according to the wearing mode signal, the sound channel output of the audio signal played by the terminal. That is, the terminal may automatically control sound channel output of left and right earpieces of the headset when the headset is reversely worn, and a user does not need to transpose wearing positions of the headset earpieces, so that headset sound channel switching efficiency can be improved.

In another implementation, the headset may further include a detection module and a judging module.

The detection module is configured to: detect a distance between the headset and an obstacle, and send the distance to the judging module.

The judging module is configured to determine whether the distance falls within a preset distance threshold.

When the distance falls beyond the preset distance threshold, the determining module determines that the wearing mode of the headset is the reverse headset wearing mode; or when the distance falls within the preset distance threshold, determines that the wearing mode of the headset is the correct headset wearing mode.

In still another implementation, a specific manner in which the communications module sends the wearing mode signal to the terminal by using the communication connection may include:

when the communication connection is a wired connection, and the wired connection includes an audio input channel between the headset and the terminal, sending the wearing mode signal to the terminal by using the audio input channel, where the wearing mode signal is a carrier signal; the carrier signal may be a specified carrier signal, such as a modulated carrier in a specified frequency or a carrier signal in a specified waveform; and the carrier signal may be used to indicate at least one of the following: the headset is reversely worn or the headset is correctly worn; or when the communication connection is a wireless connection (for example, a Bluetooth connection), sending the wearing mode signal to the terminal by using the wireless connection, where the wearing mode signal is an extended code.

A sixth aspect of the embodiments of the present invention discloses another headset. The headset includes a processor, a communications interface, a distance sensor, and the like. The processor may be configured to determine a wearing mode of the headset. The wearing mode includes a reverse headset wearing mode and a correct headset wearing mode. Distance sensors are separately disposed on a same side of left and right earpieces of the headset when the left and right earpieces of the headset are placed facing each other, and are configured to detect distances between the headset earpieces and obstacles, so as to help the processor determine the wearing mode of the headset. The communications interface may be configured to send the wearing mode signal to a terminal by using a communication connection pre-established between the headset and the terminal, so that the terminal can control sound channel output of the headset according to the wearing mode signal, for example, performing headset sound channel switching, so as to improve headset sound channel switching efficiency.

A seventh aspect of the embodiments of the present invention discloses still another headset sound channel control method. The method is applied to a headset sound channel control system, the system may include a terminal and a headset that establishes a communication connection to the terminal, and the method may include:

determining, by the headset, a wearing mode of the headset, generating a wearing mode signal according to the wearing mode of the headset, and sending the wearing mode signal to the terminal by using the communication connection, where the wearing mode includes a reverse headset wearing mode and a correct headset wearing mode, and the wearing mode signal is used to indicate that the headset is reversely worn or the headset is correctly worn, so that after receiving the wearing mode signal, the terminal can control, according to the wearing mode signal, sound channel output of an audio signal played by the terminal.

In this manner, the headset may determine the wearing mode of the headset, and notify the terminal, so that the terminal can control a sound channel output manner of left and right earpieces of the headset according to the wearing mode (the reverse wearing mode or the correct wearing mode) of the headset. That is, the terminal may automatically control sound channel output of the left and right earpieces of the headset when the headset is reversely worn, and a user does not need to transpose wearing positions of the headset earpieces, so that headset sound channel switching efficiency can be improved.

An eighth aspect of the embodiments of the present invention discloses a headset sound channel control system. The system includes a headset and a terminal. The headset is mainly configured to: determine a wearing mode of the headset, and notify the terminal. The terminal is mainly configured to control sound channel output of the headset after receiving the notification of the headset, for example, performing headset sound channel switching when the headset is reversely worn, so that headset sound channel switching efficiency can be improved.

BRIEF DESCRIPTION OF DRAWINGS

To describe the technical solutions in the embodiments of the present invention more clearly, the following briefly describes the accompanying drawings required for describing the embodiments. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the embodiments of the present invention with reference to the accompanying drawings in the embodiments of the present invention. Apparently, the described embodiments are merely some but not all of the embodiments of the present invention. All other embodiments obtained by a person of ordinary skill in the art based on the embodiments of the present invention without creative efforts shall fall within the protection scope of the present invention.

The embodiments of the present invention disclose a headset sound channel control method and system, and a related device, so that headset sound channel switching efficiency can be improved. Details are separately described below.

Figure 1:
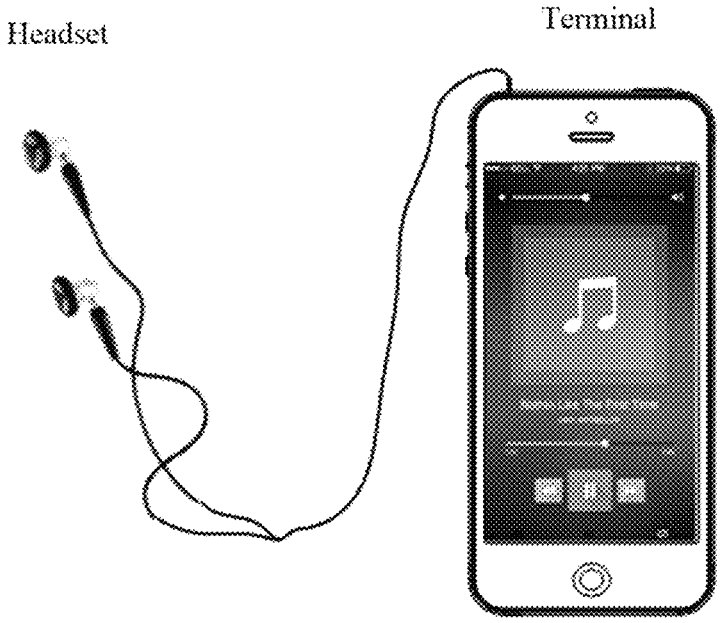
FIG. 1 is a schematic diagram of a scenario of headset sound channel control according to an embodiment of the present invention.

To better understand the headset sound channel control method and system, and the related device disclosed in the embodiments of the present invention, the following first describes a scenario applicable to the embodiments of the present invention. Referring to FIG. 1, FIG. 1 is a schematic diagram of a scenario of headset sound channel control according to an embodiment of the present invention. A headset and a terminal are included in the scenario shown in FIG. 1. The headset is a stereo headset, and has an audio-left channel and an audio-right channel. The headset may include a wireless headset (for example, a Bluetooth headset) and a wired headset (that is, a headset with a 3.5 mm headset interface, including a headphone, an earphone, an ear hook headphone, and the like). The headset may establish a communication connection to the terminal by using a 3.5 mm headset interface, or may establish a communication connection to the terminal by means of Bluetooth. This is not limited in this embodiment of the present invention. The terminal may include but is not limited to a terminal that may establish a communication connection to the headset, such as a smartphone (such as an Android mobile phone or an iOS mobile phone), a tablet computer, a palmtop computer, a personal digital assistant (Personal Digital Assistant, PDA), a mobile Internet device (Mobile Internet Device, MID), or an intelligent wearable device.

When the headset and the terminal establish the communication connection, if the terminal is on a call, playing music or a video, starting a game, or the like, the terminal outputs an audio signal by using the headset, and sound heard by a user by using the headset is stereo.

Figure 2:
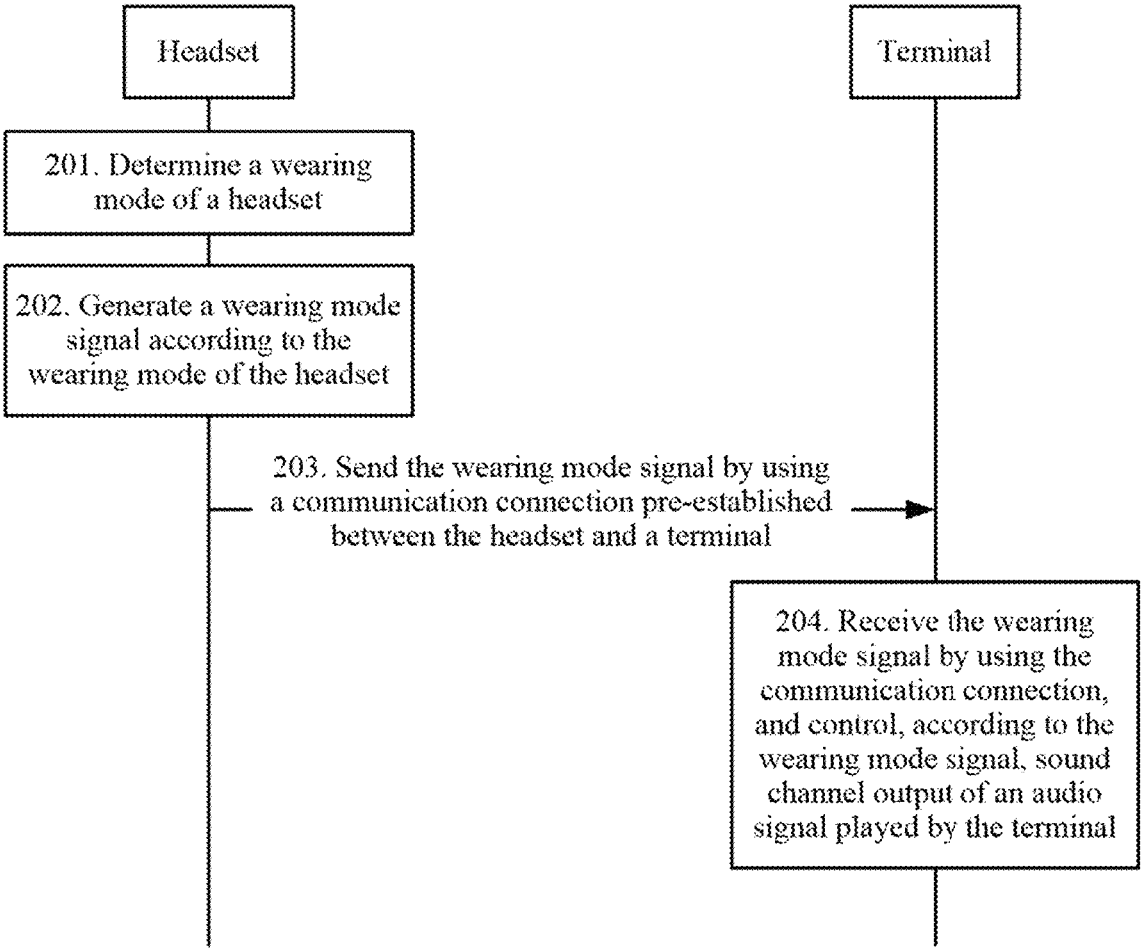
FIG. 2 is a schematic flowchart of a headset sound channel control method according to an embodiment of the present invention.

Based on the scenario shown in FIG. 1, an embodiment of the present invention discloses a headset sound channel control method. Referring to FIG. 2, FIG. 2 is a schematic flowchart of a headset sound channel control method according to an embodiment of the present invention. The method in FIG. 2 may be applied to a headset sound channel control system. The system includes a terminal and a headset that pre-establishes a communication connection to the terminal. As shown in FIG. 2, the headset sound channel control method may include the following steps.

201. The headset determines a wearing mode of the headset.

In this embodiment of the present invention, the headset and the terminal establish a communication connection. The headset and the terminal may establish the communication connection in the following two manners. One is a wired connection, that is, the headset and the terminal establish the connection by plugging a headset interface into a headset socket of the terminal. The other is a wireless connection, that is, the headset and the terminal establish the connection by means of Bluetooth. After the headset and the terminal establish the communication connection, the headset may determine the wearing mode of the headset. The wearing mode includes a reverse headset wearing mode and a correct headset wearing mode.

Figure 3:
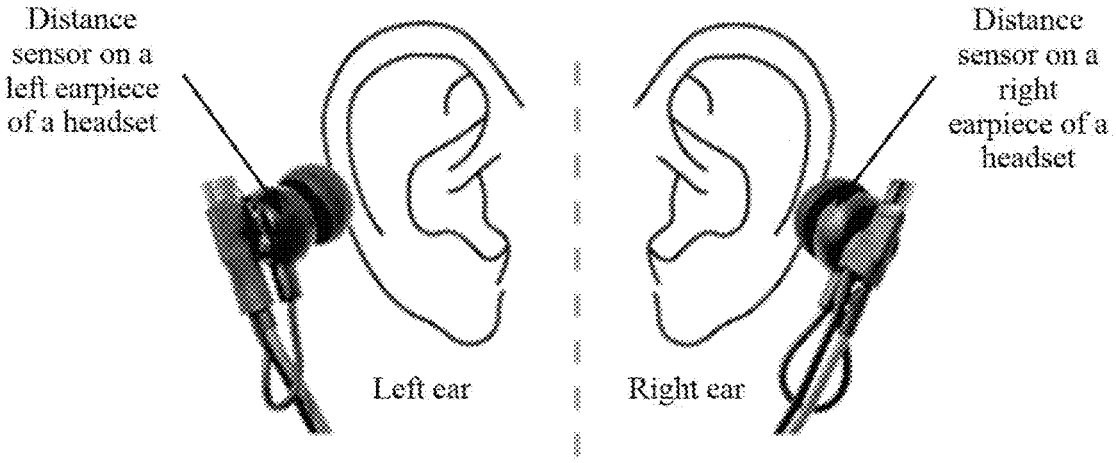
FIG. 3 is a schematic diagram of a scenario of determining a wearing mode of a headset according to an embodiment of the present invention.

Specifically, referring to FIG. 3, FIG. 3 is a schematic diagram of a scenario of determining a wearing mode of a headset according to an embodiment of the present invention. Distance sensors are separately disposed at opposite positions (for example, positions of distance sensors shown in FIG. 3) of left and right earpieces of the headset. The distance sensors are specifically disposed on a same side of the left and right earpieces when the left and right earpieces are disposed facing each other. If a user correctly wears the headset (that is, the left earpiece of the headset is worn on a left ear of the user, and the right earpiece of the headset is worn on a right ear of the user), distances detected by the distance sensors on the two earpieces are longer (that is, the distances detected by the distance sensors fall within a specified distance range greater than a distance threshold), and the wearing mode of the headset is the correct headset wearing mode; or if a user reversely wears the headset, distances (that is, distances between the distance sensors and auricles) detected by the distance sensors are shorter, and the wearing mode of the headset is the reverse headset wearing mode. Certainly, the distance sensors may be both disposed on the other sides of the left and right earpieces. If a user correctly wears the headset, distances detected by the distance sensors on the two earpieces are shorter (that is, the distances detected by the distance sensors fall within a specified distance range less than a distance threshold); or if a user reversely wears the headset, distances (that is, distances between the distance sensors and auricles) detected by the distance sensors on the two earpieces are longer. In this manner, it can be determined whether the user reversely wears the headset.

In specific implementation, a main manner in which the headset determines the wearing mode of the headset may include the following steps.

(11) The headset detects a distance between the headset and an obstacle, and determines whether the distance falls within a preset distance threshold.

(12) When the distance falls beyond the preset distance threshold, determine that the wearing mode of the headset is a reverse headset wearing mode.

(13) When the distance falls within the preset distance threshold, determine that the wearing mode of the headset is a correct headset wearing mode.

In this embodiment of the present invention, the headset mainly detects the distance between the headset and the obstacle by using the distance sensor disposed on the left or right earpiece of the headset, so as to obtain the distance; and determines whether the distance falls within the preset distance threshold, so as to determine the wearing mode of the headset.

It should be noted that the headset may obtain a distance detected by the distance sensor on the left earpiece of the headset, may obtain a distance detected by the distance sensor on the right earpiece of the headset, or may obtain both distances detected by the distance sensors on the two earpieces. This is not limited in this embodiment of the present invention. The preset distance threshold may be understood as: if the distance sensor is disposed on a side close to an ear of the user when the headset earpieces are correctly worn, the preset distance threshold is a distance range that is less than a distance threshold. For example, the preset distance threshold is less than 1 centimeter. If the distance sensor is disposed on a side far from an ear of the user when the headset earpieces are correctly worn, the preset distance threshold is a distance range that is greater than a distance threshold. For example, the preset distance threshold is greater than 3 centimeters.

In this embodiment of the present invention, the headset may determine whether a distance detected by a distance sensor disposed on any headset earpiece falls within the preset distance threshold, or may determine whether the distances detected by the distance sensors disposed on the left and right earpieces of the headset both fall within the preset distance threshold.

Therefore, when the distance falls beyond the preset distance threshold, the headset may determine that the headset is reversely worn; or when the distance falls within the preset distance threshold, may determine that the headset is correctly worn.

In the foregoing manner, the headset may first determine whether the headset is in a wearing state, and then detect the distance between the headset and the obstacle after the headset is in a wearing state.

It should be noted that a specific manner in which the headset determines whether the headset is in a wearing state may be as follows: The headset is provided with an outside microphone used to obtain, when the user wears the headset, external sound that does not pass through the obstacle, and an inside microphone used to obtain, when the user wears the headset, external sound that passes through the obstacle. In this case, the inside microphone and the outside microphone may detect a sound signal in an environment in real time, and compare obtained sound signals. If strength of a sound signal obtained by the inside microphone is less than strength of a sound signal obtained by the outside microphone, it indicates that the headset is in a wearing state; otherwise, it indicates that the headset is not in a wearing state.

202. The headset generates a wearing mode signal according to the wearing mode of the headset.

In this embodiment of the present invention, the wearing mode signal may be used to indicate that the headset is reversely worn, or may be used to indicate that the headset is correctly worn. Therefore, the headset may generate the wearing mode signal according to a result of determining the wearing mode of the headset.

That is, when determining that the headset is reversely worn, the headset generates a wearing mode signal that is used to indicate that the headset is reversely worn; or when the headset is correctly worn, generates a wearing mode signal that is used to indicate that the headset is correctly worn.

It should be noted that, the headset may generate, only when the headset is reversely worn, the wearing mode signal that is used to indicate that the headset is reversely worn; may generate, only when the headset is correctly worn, the wearing mode signal that is used to indicate that the headset is correctly worn; or may generate, when the headset determines that the headset is reversely worn, the wearing mode signal that is used to indicate that the headset is reversely worn, and generate, when the headset is correctly worn, the wearing mode signal that is used to indicate that the headset is correctly worn. This is not limited in this embodiment of the present invention.

203. The headset sends the wearing mode signal to the terminal by using a communication connection pre-established between the headset and the terminal.

204. The terminal receives, by using the communication connection, the wearing mode signal sent by the headset, and controls, according to the wearing mode signal, sound channel output of an audio signal played by the terminal.

In this embodiment of the present invention, after receiving the wearing mode signal, the terminal may control audio-left channel output and audio-right channel output of the headset according to the wearing mode signal. When the wearing mode signal is used to indicate that the headset is reversely worn, the terminal outputs the played audio signal by means of sound channel switching. When the wearing mode signal is used to indicate that the headset is correctly worn, the terminal does not perform any operation. That is, a current output manner of an audio-left channel and an audio-right channel of the headset is maintained.

Specifically, it is assumed that the left earpiece of the headset is corresponding to the audio-left channel output, and the right earpiece is corresponding to the audio-right channel output. When the left earpiece is worn on the right ear of the user, or the right earpiece is worn on the left ear of the user, the headset can detect that the headset is reversely worn, so as to notify the terminal. Therefore, the terminal switches an audio signal that is originally to be output from the audio-left channel to the audio-right channel for output, and switches an audio signal that is to be output from the audio-right channel to the audio-left channel for output. In this way, even if the user reversely wears the headset, the user may hear an audio signal meeting a binaural effect. The binaural effect is an effect of determining a sound direction based on a volume difference, a time difference, and a timbre difference between two ears of a person. The audio signal may be an audio signal output by the terminal, such as music or a voice. Certainly, when the terminal outputs the audio signal after performing sound channel switching, the headset may still detect whether the headset is reversely worn. Once the user correctly wears the headset earpieces, the terminal outputs the audio signal in a default sound channel output manner (that is, the left earpiece is corresponding to the audio-left channel output, and the right earpiece is corresponding to the audio-right channel output).

It can be learned that in the method shown in FIG. 2, the headset may determine the wearing mode of the headset, generate the wearing mode signal, and send the signal to the terminal, so that the terminal can control, according to the wearing mode signal, that is, the wearing mode (the reverse wearing mode or the correct wearing mode) of the headset, the sound channel output of the audio signal played by the terminal. In this manner, the headset may detect whether the headset is reversely worn, and the terminal automatically performs sound channel switching when the headset is reversely worn. In this way, the user can implement sound channel switching without transposing the left and right earpieces of the headset, thereby improving headset sound channel switching efficiency.

Figure 4A:
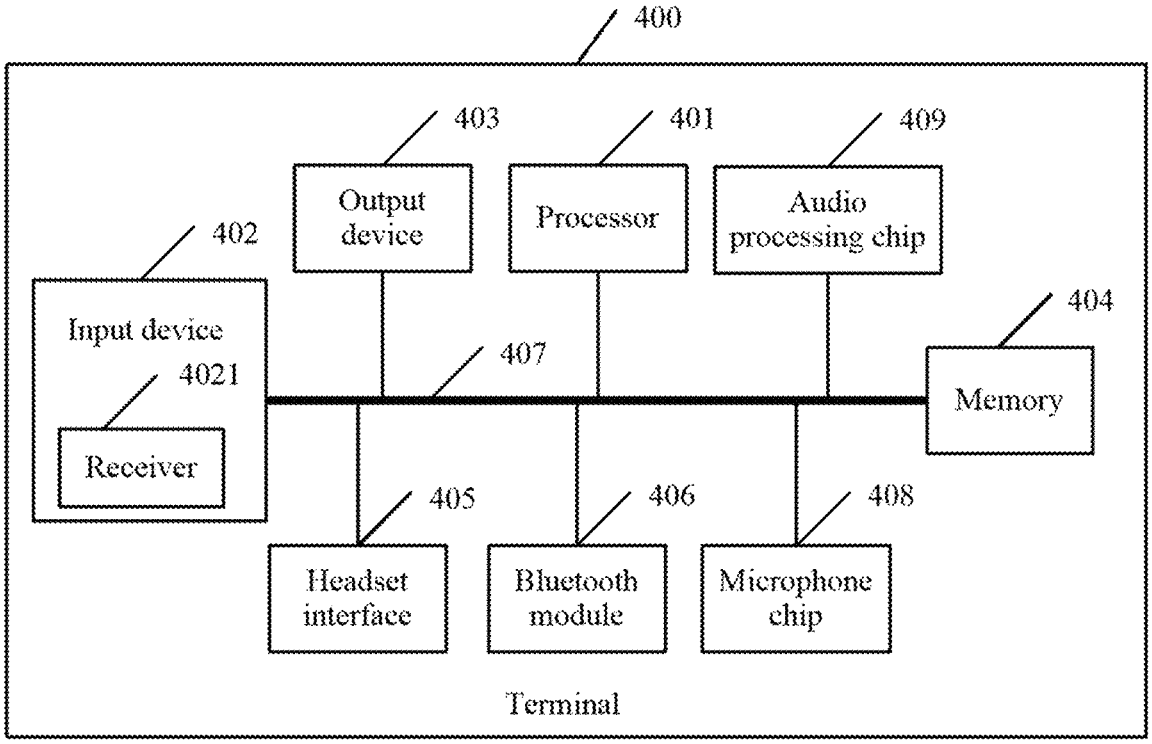
FIG. 4*a* is a schematic structural diagram of a terminal according to an embodiment of the present invention.

Based on the scenario shown in FIG. 1, an embodiment of the present invention discloses a terminal. Referring to FIG. 4*a*, FIG. 4*a* is a schematic structural diagram of a terminal according to an embodiment of the present invention. A terminal 400 in FIG. 4*a* may include: at least one processor 401, for example, a CPU, an input device 402, an output device 403, a memory 404, a headset interface 405, a Bluetooth module 406, a communications bus 407, a microphone chip 408, and an audio processing chip 409.

The headset interface 405 and a wired headset establish a communication connection. When the headset is plugged into the headset interface 405, a wired connection is established between the headset and the terminal 400. The wired connection includes an audio input channel between the headset and the terminal 400, so that the headset and the terminal 400 can communicate with each other. For example, a user inputs a sound signal to the terminal 400 by using the headset, and sends an instruction, such as changing a song, adjusting volume, terminating a call, to the terminal 400 by pressing a physical button on the headset, and the terminal 400 outputs a sound signal or the like in played music or a played video to the user by using the headset. A signal transmitted during communication between the terminal 400 and the wired headset is generally an analog signal, for example, a modulated carrier.

The microphone chip 408 mainly parses the sound signal. That is, after receiving a carrier signal sent by the headset by using the audio input channel, a receiver 4021 sends the carrier signal to the microphone chip 408, so that the microphone chip 408 parses the carrier signal to obtain an electrical signal, and sends the electrical signal obtained by means of parsing to the processor 401 for processing.

The Bluetooth module 406 and a (Bluetooth) headset establish a communication connection. When the (Bluetooth) headset and the terminal 400 establish a Bluetooth connection, the (Bluetooth) headset and the terminal 400 can communicate with each other. A signal transmitted during communication between the terminal 400 and the (Bluetooth) headset is generally a digital signal, for example, a scanned code. The Bluetooth module 406 may further parse a digital signal sent by the headset, and send a parsing result to the processor 401 for processing.

The audio processing chip 409 mainly controls, according to an audio instruction sent by the processor 401, an audio signal played by the terminal 400. For example, the audio processing chip 409 performs sound rendering, sound channel switching output, volume adjustment, and the like on audio data.

The memory 404 stores an operating system, computer code, data, and the like that are to be used by the terminal 400. The memory 404 may include a read-only memory (Read-Only Memory, ROM), a random access memory (Random Access Memory, RAM), a hard disk drive, and the like. An application program in this embodiment of the present invention is stored in the memory 404.

The output device 403 may be a screen, a display, a speaker, a transmitter, or the like, and is configured to display or play an image, or an audio file or a video file, or send a data instruction generated by the terminal 400. A graphical user interface (Graphical User Interface, GUI) is usually disposed on the screen or the display. The GUI provides an easy-to-use user interface between the terminal 400 and the operating system or an application running on the terminal 400. The GUI represents a program, a file, and an operation option by using a graphical image. A user may select and activate various graphical images by operating the screen or the display, so as to enable a related function and task.

The input device 402 may be a touch panel, the receiver 4021, or the like. The receiver 4021 is configured to receive a data instruction sent by an external device. The touch panel may be a touchpad or a touchscreen, and may receive an operation instruction entered by the user based on various sensing technologies, including but not being limited to capacitance induction, resistance induction, surface acoustic wave sensing, pressure sensing, light sensing, and the like. The touchpad or the touchscreen and the screen or the display may be integrated together, or may be independent components. The input device 404 may be a single-point or multi-point input device.

It should be noted that the receiver 4021 and the transmitter may be integrated as a communications interface for receiving a data instruction sent by the external device, sending a data instruction to the external device, and the like.

The processor 401 processes various types of data, and executes received various instructions, and may control receiving and operating of data input and output between the components of the terminal 400. The processor 401 may be implemented on a signal chip, multiple chips, or multiple electronic elements, and may use multiple architectures, including a dedicated or an embedded processor, a dedicated processor, a controller, an ASIC, and the like.

The communications bus 407 implements a communication connection between these components including the processor 401, the input device 402, the output device 403, the memory 404, the headset interface 405, the Bluetooth module 406, the microphone chip 408, and the audio processing chip 409.

The receiver 4021 may receive, by using a communication connection established between the terminal 400 and the headset, a wearing mode signal sent by the headset. The wearing mode signal is used to indicate that the headset is reversely worn or the headset is correctly worn. After receiving the wearing mode signal, the receiver 4021 sends the wearing mode signal to the processor 401 for processing. After obtaining the wearing mode signal, the processor 401 controls, according to the wearing mode signal, sound channel output of an audio signal played by the terminal 400.

A specific manner in which the receiver 4021 receives, by using the communication connection established between the terminal 400 and the headset, the wearing mode signal sent by the headset may be as follows:

Manner 1:

When the communication connection is a wired connection, and the wired connection includes an audio input channel (a communications line that can transmit a sound signal collected by a microphone) between the headset and the terminal 400, the receiver 4021 receives, by using the audio input channel, the wearing mode signal sent by the headset, where the wearing mode signal is a carrier signal; the carrier signal may be a specified carrier signal, such as a modulated carrier in a specified frequency or a carrier signal in a specified waveform; and the carrier signal may be used to indicate at least one of the following: the headset is reversely worn or the headset is correctly worn.

Figure 4B:
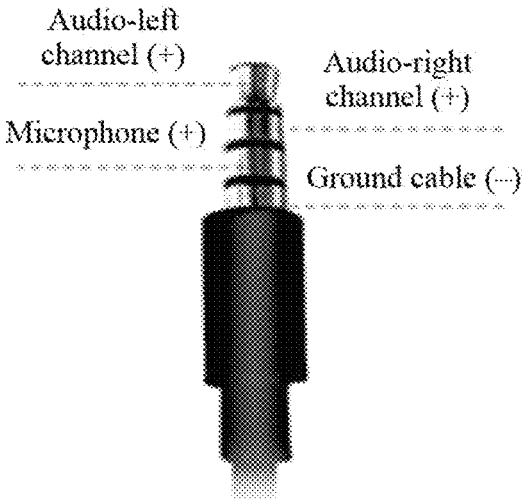
FIG. 4*b* is a schematic diagram of a 3.5 mm headset interface according to an embodiment of the present invention.
Figure 4C:
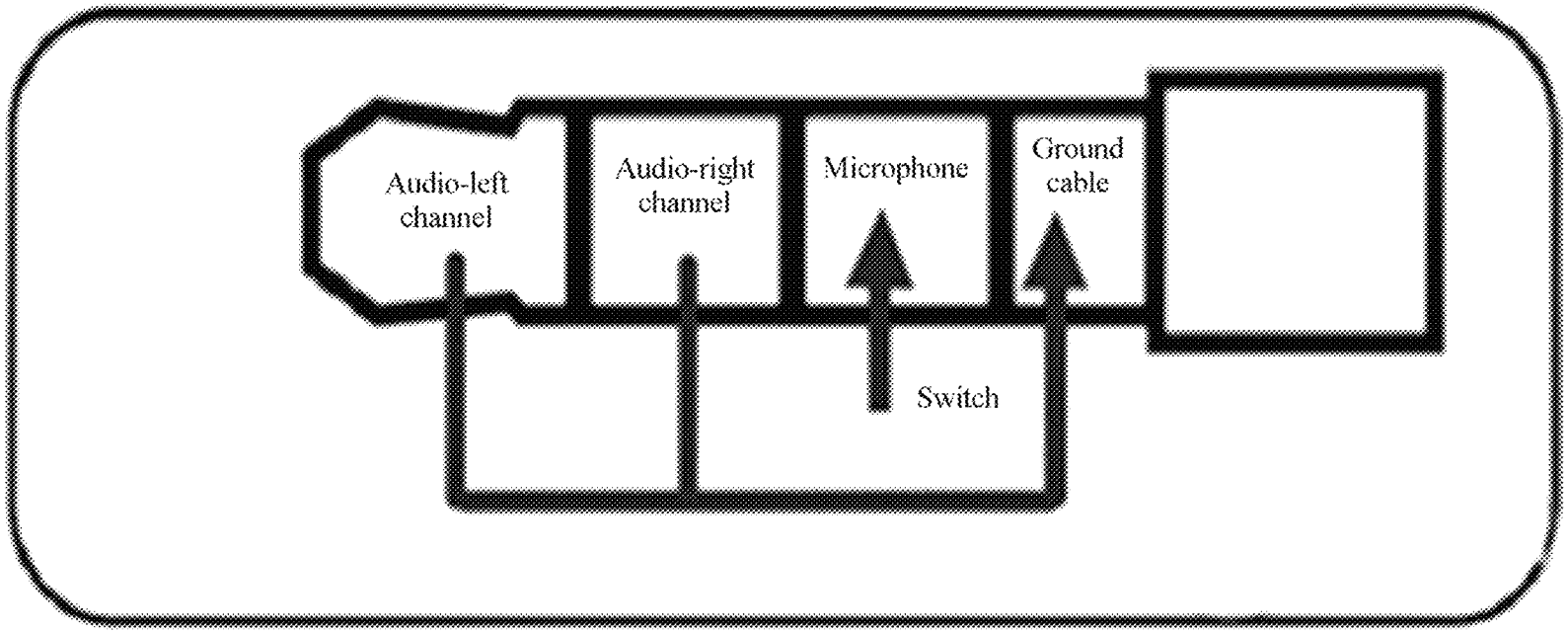
FIG. 4*c* is a schematic diagram of a line of a 3.5 mm headset interface according to an embodiment of the present invention.

Referring to FIG. 4*b* and FIG. 4*c*, FIG. 4*b* is a schematic diagram of a 3.5 mm headset interface according to an embodiment of the present invention, and FIG. 4*c* is a schematic diagram of a line of a 3.5 mm headset interface according to an embodiment of the present invention. A current wired headset generally has a 3.5 mm headset interface. As shown in FIG. 4*b*, the headset interface includes four signal channels: an audio-left channel (+), an audio-right channel (+), a microphone channel (+) (also referred to as an audio input channel), and a ground cable (−). "+" represents a high voltage, and "−" represents a low voltage. In FIG. 4*c*, the audio-left channel and the audio-right channel are usually connected to the ground cable. There is a switch between the microphone channel and the ground cable. The switch may be a hardware switch or a software switch. Therefore, usually, the microphone channel is not always connected to the ground cable, but connected to the ground cable only when the terminal 400 runs a special application (for example, an application having a calling function, a recording function, or the like), so as to enter a working state. After a user plugs the headset interface into a headset socket of the terminal, if an application currently run on the terminal 400 has a calling function, the microphone channel is connected to the ground cable, and the user may input sound to the terminal 400 by using the microphone and may send some control instructions to the terminal 400, such as a volume control instruction or a song switching control instruction used during music play, or a call termination control instruction used during a call. In addition, the headset may obtain power from the terminal 400, so as to start a distance sensor to detect a distance between a headset earpiece and a closest obstacle. A sound signal is generally a waveform signal, and most signals sent by the headset to the user by using the microphone are waveform signals. Therefore, when determining a wearing mode of the headset, for example, when determining that the headset is reversely worn, the headset may send a carrier signal to the terminal 400 by using the audio input channel, so that the terminal 400 can receive an audio signal and the carrier signal by using the audio input channel.

The carrier signal is used to indicate the wearing mode of the headset. It may be specified between the headset and the terminal 400 that a specified carrier signal indicating the wearing mode of the headset may be a modulated carrier in a specified frequency, or a carrier signal in a specified waveform (such as a sine wave). This is not limited in this embodiment of the present invention. For example, the terminal 400 may specify that a modulated carrier in a first frequency is used to indicate that the headset is reversely worn, and a modulated carrier in a second frequency is used to indicate that the headset is correctly worn.

Manner 2:

When the communication connection is a wireless connection (for example, a Bluetooth connection), the receiver 4021 receives, by using the wireless connection, the wearing mode signal sent by the headset, where the wearing mode signal is an extended code.

In this embodiment of the present invention, a current headset may further include a Bluetooth headset. That is, the headset and the terminal 400 establish a connection by using the Bluetooth module 406. Certainly, the headset and the terminal 400 may establish a Wi-Fi wireless connection or the like. Therefore, when a wireless headset such as a Bluetooth headset and the terminal 400 establish a wireless connection, if the headset determines a wearing mode of the headset, the headset may send the wearing mode signal to the terminal 400 in a wireless connection manner such as Bluetooth, so as to indicate the wearing mode of the headset. For example, when the user reversely wears the headset, the headset may send, to the terminal 400 by means of Bluetooth, a wearing mode signal that is used to indicate that the headset is reversely worn, so that the receiver 4021 (which is specifically the Bluetooth module 406) receives the wearing mode signal sent by the headset.

It should be noted that a signal sent by a current Bluetooth headset to the terminal 400 is a digital signal (that is, a scanned code). Different scanned codes are corresponding to indication signals having different functions. As shown in Table 1, the indication signals include a volume adjustment signal, a song switching signal, a pause signal, a play signal, and the like. Therefore, an extended code may be added based on the existing scanned code to indicate the wearing mode of the headset.

For example, an extended code that is used to indicate that the headset is reversely worn may be added. The extended code may be any scanned code such as "003E7 999" other than the scanned code shown in Table 1 This is not limited in this embodiment of the present invention. A mapping string corresponding to "003E7 999" is "CHANNEL_REVERSE", and is used to indicate that the headset is reversely worn. Certainly, an extended code that is used to indicate that the headset is correctly worn may be added. This is not limited in this embodiment of the present invention.

TABLE 1

| Scanned code | Function | Mapping string |
|---|---|---|
| 00c8 200 | Play | MEDIA_PLAY |
| 00c9 201 | Pause | MEDIA_PAUSE |
| 00a3 163 | Next | MEDIA_NEXT |
| 00a5 165 | Previous | MEDIA_PREVIOUS |

When the receiver 4021 receives the wearing mode signal, the terminal 400 may further parse the wearing mode signal to obtain a parsing result, and control, according to the parsing result, the sound channel output of the audio signal played by the terminal 400.

A specific manner in which the terminal 400 parses the wearing mode signal to obtain the parsing result may be as follows:

Manner 1:

When the wearing mode signal is a carrier signal, the microphone chip 408 parses the carrier signal to obtain an electrical signal, and sends the electrical signal to the processor 401, so that the processor 401 compares the electrical signal with a pre-stored signal that is used to indicate a wearing mode of the headset. The signal that is used to indicate the wearing mode of the headset includes a signal that is used to indicate that the headset is reversely worn and a signal that is used to indicate that the headset is correctly worn. If the signal obtained by means of parsing matches the signal that is used to indicate that the headset is reversely worn, the terminal determines that the headset is reversely worn; or if the signal obtained by means of parsing matches the signal that is used to indicate that the headset is correctly worn, the terminal determines that the headset is correctly worn.

In this embodiment of the present invention, the signal that is used to indicate the wearing mode of the headset may include at least one of the signal that is used to indicate that the headset is reversely worn or the signal that is used to indicate that the headset is correctly worn. This is not limited in this embodiment of the present invention. After receiving the carrier signal, the terminal may compare the carrier signal with all pre-stored carrier signals, and when determining that the signal obtained by means of parsing is the signal that is used to indicate the wearing mode of the headset, further determine whether a frequency or a waveform of the signal obtained by means of parsing is consistent with that of the signal that is used to indicate that the headset is reversely worn, or consistent with that of the signal that is used to indicate that the headset is correctly worn. In this manner, the wearing mode signal may be parsed to obtain the parsing result.

Manner 2:

When the wearing mode signal is an extended code, the Bluetooth module 406 parses the extended code, and sends a parsing result to the processor 401, so that the processor 401 compares the extended code obtained by means of parsing with an extended code that is used to indicate a wearing mode of the headset. The extended code that is used to indicate the wearing mode of the headset includes an extended code that is used to indicate that the headset is reversely worn and an extended code that is used to indicate that the headset is correctly worn. If the extended code matches the extended code that is used to indicate that the headset is reversely worn, the terminal determines that the headset is reversely worn; or if the extended code matches the extended code that is used to indicate that the headset is correctly worn, the terminal determines that the headset is correctly worn.

In this embodiment of the present invention, the extended code that is used to indicate the wearing mode of the headset includes at least one of the extended code that is used to indicate that the headset is reversely worn or the extended code that is used to indicate that the headset is correctly worn. This is not limited in this embodiment of the present invention. After receiving the extended code, the terminal may compare the extended code with all pre-stored scanned codes, and when determining that the extended code is a scanned code that is used to indicate the wearing mode of the headset, further determine whether the extended code is consistent with a scanned code that is used to indicate that the headset is reversely worn, or consistent with a scanned code that is used to indicate that the headset is correctly worn. In this manner, the wearing mode signal may be parsed to obtain the parsing result.

In this embodiment of the present invention, when the wearing mode signal is used to indicate that the headset is reversely worn, the headset determines that the headset is in a wearing state, and a distance detected by a distance sensor on the headset falls beyond a specified distance range, the wearing mode signal is sent to the terminal 400 by using the communication connection. The processor 401 controls, according to the wearing mode signal, the audio processing chip 409 to output, by means of sound channel switching, the audio signal played by the terminal 400.

Specifically, a specific manner in which the processor 401 controls, according to the wearing mode signal, the audio processing chip 409 to output, by means of sound channel switching, the audio signal played by the terminal 400 may be as follows: After reading an audio file stored in the memory 404, an application program that has an audio play function sends the audio file to the processor 401; the processor 401 parses the audio file to obtain audio data, and sends the audio data to the audio processing chip 409; the processor 401 sends a sound channel switching instruction to the audio processing chip 409 when the wearing mode signal is used to indicate that the headset is reversely worn; and after receiving the sound channel switching instruction, and performing sound rendering on the audio data, the audio processing chip 409 sends, to an audio-right channel interface for output, audio data output from an audio-left channel, and sends, to an audio-left channel interface for output, audio data output from an audio-right channel. The audio-left channel interface is connected to the audio-left channel of the headset, and the audio-right channel interface is connected to the audio-right channel of the headset.

When the headset is reversely worn, the processor 401 may control, according to the parsing result or the wearing mode signal in the following cases, the audio processing chip 409 to output, by means of sound channel switching, the audio signal played by the terminal 400.

Manner 1:

When the parsing result is that the headset is reversely worn, or the wearing mode signal is used to indicate that the headset is reversely worn, the processor 401 detects whether an application program running in a foreground is an application program that has an audio output function, such as a music player, a video player, or a game application. If the application program running in the foreground is the application program that has an audio output function, the processor 401 controls, according to the parsing result or the wearing mode signal, the audio processing chip 409 to output, by means of sound channel switching, the audio signal played by the terminal 400.

In this embodiment of the present invention, the application program that has an audio output function may include but is not limited to any one or more of a social application, a calling application, a music player, a video player, or a game application. The application program that has an audio output function may be a specified application program, such as a music player, a video player, or a game application. This is not limited in this embodiment of the present invention.

Therefore, after the microphone chip 408 or the Bluetooth module 406 parses the wearing mode signal to obtain the parsing result or the receiver 4021 receives the wearing mode signal, the processor 401 controls, only when the application program running in the foreground is the application program that has an audio output function, the audio processing chip 409 to output the audio signal by means of sound channel switching. However, if the current running application program is not the application program that has an audio output function, the output device 403 may output prompt information to indicate the user that the headset is reversely worn.

It can be learned that the terminal 400 performs headset sound channel switching only when the headset is reversely worn and the application program running in the foreground is the application program that has an audio output function. This can avoid unnecessary sound channel switching, and improve sound channel switching accuracy.

Manner 2:

When the parsing result is that the headset is reversely worn, or the wearing mode signal is used to indicate that the headset is reversely worn, the processor 401 generates, according to the parsing result or the wearing mode signal, prompt information that is used to indicate the user that the headset is reversely worn and whether sound channel switching is to be performed, and the output device 403 may output the prompt information. After the output device 493 outputs the prompt information, the input device 402 may receive a sound channel control instruction entered by the user according to the prompt information. The sound channel control instruction is used to instruct to perform sound channel switching or maintain current sound channel output. If the sound channel control instruction is used to instruct to perform sound channel switching, the processor 401 controls, according to the parsing result, the audio processing chip 409 to output, by means of sound channel switching, the audio signal played by the terminal 400. The prompt information may be a voice prompt or a text prompt.

In this embodiment of the present invention, when the prompt information is text information, the output device 403 may display the prompt information on the screen, or may send the prompt information to a wearable device to display the prompt information on a screen of the wearable device. When the prompt information is a voice prompt, the output device 403 may send the prompt information to the headset by using the Bluetooth module 406 or the headset interface 405, so as to output the prompt information by using the headset. This is not limited in this embodiment of the present invention.

Figure 4D:
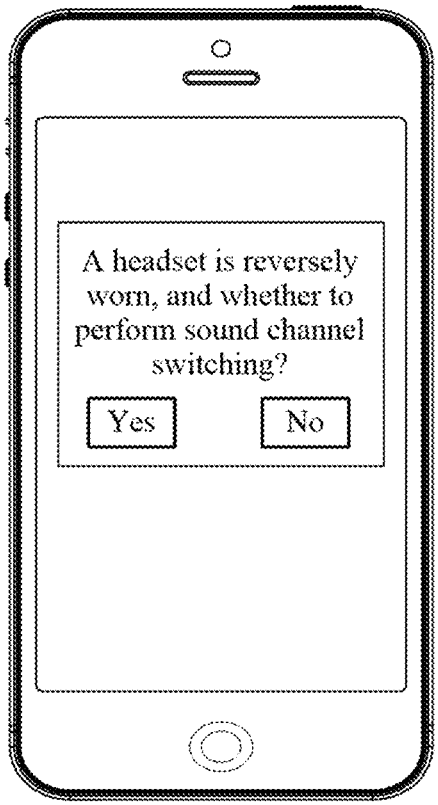
FIG. 4*d* is a schematic diagram of one of scenarios in which a terminal indicates a user that a headset is reversely worn according to an embodiment of the present invention.

The prompt information may indicate the user that "the headset is reversely worn and whether sound channel switching is to be performed". If the prompt information is a text prompt, a prompt box may be further displayed on the screen. Referring to FIG. 4*d*, FIG. 4*d* is a schematic diagram of one of scenarios in which a terminal indicates a user that a headset is reversely worn according to an embodiment of the present invention. In FIG. 4*d*, the prompt box may include text content "a headset is reversely worn and whether to perform sound channel switching", and may further include two buttons "Yes" and "No" for the user to choose. If the user taps "Yes", the user may input, by using the input device 402, a sound channel control instruction that is used to instruct to perform sound channel switching; or if the user taps "NO", the user may input, by using the input device 402, a sound channel control instruction that is used to instruct to maintain current sound channel output. Therefore, after the output device 403 outputs the prompt information, the processor 401 may detect whether the sound channel control instruction entered by the user according to the prompt information is received by the input device 402 within a preset time period. If the sound channel control instruction is used to instruct to perform sound channel switching, the processor 401 controls the audio processing chip 409 to output, by means of sound channel switching, the audio signal played by the terminal 400; or if the sound channel control instruction is used to instruct to maintain current sound channel output, the processor 401 controls the audio processing chip 409 to output, in a default or an original sound channel output manner, the audio signal played by the terminal 400.

It can be learned that after receiving the wearing mode signal that is used to indicate that the headset is reversely worn, the terminal 400 may prompt the user to determine whether to perform automatic sound channel switching or manual switching, thereby improving sound channel switching flexibility.

It should be noted that a specific manner in which the input device 402 receives the sound channel control instruction may be as follows:

Manner 1:

The processor 401 detects whether a placement manner of the terminal 400 changes within a preset time period after the output device 403 outputs the prompt information; and when the placement manner of the terminal 400 changes, generates a sound channel control instruction that is used to instruct to perform sound channel switching; or when the placement manner of the terminal 400 does not change, generates a sound channel control instruction that is used to instruct to maintain current sound channel output, so as to send the generated sound channel control instruction to the input device 402.

In this embodiment of the present invention, the terminal 400 may pre-specify that the sound channel control instruction that is used to instruct to perform sound channel switching is that the placement manner of the terminal 400 changes within the preset time period after the output device 403 outputs the prompt information. Therefore, after the output device 403 outputs the prompt information, the user may control, by changing the placement manner of the terminal 400 (for example, the user vertically places a mobile phone that was horizontally placed), the terminal 400 to perform headset sound channel switching. If the user does not change the placement manner of the terminal 400 within the preset time period after the output device 403 outputs the prompt information, the processor 401 may control the audio processing chip 409 not to perform sound channel switching. Certainly, alternatively, if it is not detected that the placement manner of the terminal 400 changes within the preset time period after the output device 403 outputs the prompt information, the processor 401 may control the audio processing chip 409 to control a sound channel in a default processing manner, for example, performing headset sound channel switching. This is not limited in this embodiment of the present invention. The preset time period may be five seconds, 10 seconds, or the like. The placement manner may be placing face up, placing on one side, placing face down, or the like. This is not limited in this embodiment of the present invention.

Specifically, the processor 401 may detect, by using a gravity sensor disposed in the terminal 400, whether the placement manner of the terminal 400 changes.

It can be learned that when the headset is reversely worn, the user may perform sound channel switching by changing the placement manner of the terminal, thereby improving sound channel switching efficiency, enhancing user engagement, and increasing enjoyment.

Manner 2:

The processor 401 detects whether a sound channel control instruction sent by a wearable device bound to the terminal 400 is received by the receiver 4021 within a preset time period after the prompt information is output. When the communications interface 4021 does not receive the sound channel control instruction sent by the wearable device, the processor 401 generates a sound channel control instruction according to the prompt information. Alternatively, when the receiver 4021 receives the sound channel control instruction sent by the wearable device, and the sound channel control instruction is used to instruct to perform sound channel switching, the processor 401 controls, according to the parsing result, the audio processing chip 409 to output, by means of sound channel switching, the audio signal played by the terminal 400.

In this embodiment of the present invention, the preset time period may be five seconds, 10 seconds, or the like. If the sound channel control instruction sent by the wearable device is not received by the receiver 4021 within the preset time period, the processor 401 generates a default sound channel control instruction according to the prompt information. The default sound channel control instruction may be used to instruct to perform sound channel switching, or may be used to instruct to maintain current sound channel output. This is not limited in this embodiment of the present invention.

In this embodiment of the present invention, that the wearable device bound to the terminal 400 sends the sound channel control instruction to the terminal 400 may include two cases: Case 1: When the terminal 400 displays the prompt information by using the screen of the wearable device, the user may determine, by taping "Yes" or "No" on the screen, whether to perform sound channel switching, so that the wearable device generates a sound channel control instruction according to an operation performed by the user on the screen, and sends the sound channel control instruction to the terminal 400 by using a communication connection established between the wearable device and the terminal 400. Case 2: When the terminal 400 displays the prompt information by using the screen of the wearable device, the user may instruct, by shaking the terminal 400 and the wearable device at the same time, the terminal 400 to perform sound channel switching.

When the headset is reversely worn, the user may perform headset sound channel switching by using the wearable device. The terminal 400 automatically controls sound channel output when the sound channel control instruction sent by the wearable device is not received by the terminal 400 within a long time. This can not only improve headset sound channel control efficiency, but also increase enjoyment and convenience of a user operation.

Specifically, a specific manner in which the user instructs, by shaking the terminal 400 and the wearable device at the same time, the terminal 400 to perform sound channel switching may be as follows:

The processor 401 may detect whether shaking action events match, where the shaking action events occur on the terminal 400 and the bound wearable device in the preset time period after the output device 403 outputs the prompt information. The shaking action event is similar to a function of "Shake". That is, the processor 401 may detect whether the user shakes the terminal 400 and the wearable device bound to the terminal 400 at the same time. Specifically, when a first shaking action event occurs on the terminal 400, and the processor 401 detects that a second shaking action event occurs on the wearable device bound to the terminal 400, the processor 401 determines whether a shaking action direction included in the first shaking action event is the same as a shaking action direction included in the second shaking action event. If the shaking action directions are the same, the processor 401 further determines whether both a shaking action start moment included in the first shaking action event and a shaking action start moment included in the second shaking action event fall within the preset time period after the prompt information is output. If both the shaking action start moments fall within the preset time period, the processor 401 determines that the events match, where the events occur on the terminal 400 and the wearable device in the preset time period, so that the processor 401 generates the sound channel control instruction that is used to instruct to perform sound channel switching.

Figure 5:
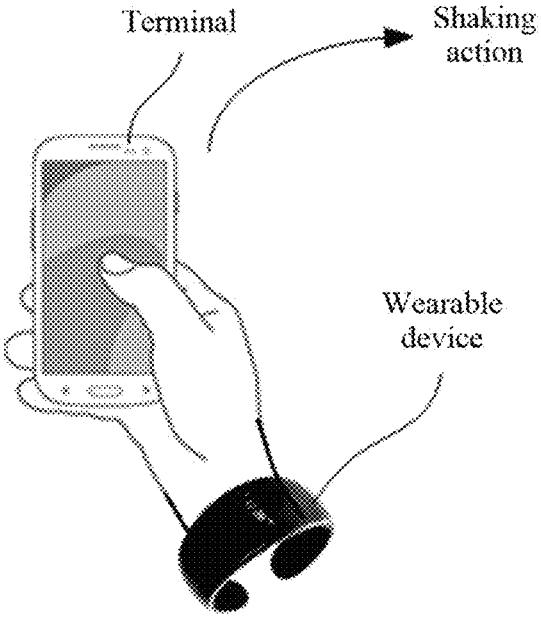
FIG. 5 is a schematic diagram of one of scenarios of generating a sound channel control instruction according to an embodiment of the present invention.

Referring to FIG. 5, FIG. 5 is a schematic diagram of one of scenarios of generating a sound channel control instruction according to an embodiment of the present invention. As shown in FIG. 5, the user may hold the terminal 400 in a hand, and a wearable device (such as a smart band, a smartwatch, a smart ring) may be further worn on the hand, of the user, holding the terminal 400. The wearable device is a wearable device bound to the terminal 400, and the terminal 400 may be connected to the wearable device by means of Bluetooth, Wi-Fi, infrared ray, or the like. In the scenario shown in FIG. 5, the user may shake the terminal 400 and the wearable device in one direction at the same time. Correspondingly, when the wearable device detects, by using an acceleration sensor or a gravity sensor, that a shaking action occurs, the wearable device may send a shaking action event that includes a shaking action start moment and shaking action duration to the terminal 400. Correspondingly, when the prompt information used to indicate whether sound channel switching is to be performed is output, the terminal 400 may detect, by using the acceleration sensor or the gravity sensor, whether the first shaking action event occurs on the terminal 400. A specific implementation in which the processor 401 detects whether shaking action events occur on the terminal 400 and the wearable device at the same time is as follows:

Manner 1: If the first shaking action event occurs on the terminal 400, the processor 401 of the terminal 400 detects whether the second shaking action event occurs on the wearable device bound to the terminal 400. If the second shaking action event occurs on the wearable device, the processor 401 determines whether the shaking action direction included in the first shaking action event is the same as the shaking action direction included in the second shaking action event. If the shaking action directions are the same, the processor 401 further determines whether both the shaking action start moment included in the first shaking action event and the shaking action start moment included in the second shaking action event fall within the preset time period after the output device 403 outputs the prompt information.

If both the shaking action start moment included in the first shaking action event and the shaking action start moment included in the second shaking action event fall within the preset time period, the processor 401 further determines whether a difference between shaking action duration included in the first shaking action event and shaking action duration included in the second shaking action event is less than a preset threshold. If the difference between the shaking action duration included in the first shaking action event and the shaking action duration included in the second shaking action event is less than the preset threshold, the processor 401 determines that the events match, where the events occur on the terminal 400 and the wearable device within the preset time period.

It should be noted that, that the shaking action direction included in the first shaking action event is the same as the shaking action direction included in the second shaking action event may be understood as: when the acceleration sensor in the terminal 400 detects that an acceleration suddenly changes (for example, the acceleration changes from 0.5 to 3 within 5 ms), the terminal 400 obtains a direction in which the acceleration is maximum. Correspondingly, the wearable device obtains, in this manner, a direction in which an acceleration is maximum. If an angle between the two directions falls within a particular range, for example, less than 10 degrees, it may be considered that the shaking action direction included in the first shaking action event is the same as the shaking action direction included in the second shaking action event.

Manner 2: Bases on Manner 1, the processor 401 may further determine whether both shaking action duration included in the first shaking action event and shaking action duration included in the second shaking action event fall within a preset time period. If both the shaking action duration included in the first shaking action event and the shaking action duration included in the second shaking action event fall within the preset time period, the processor 401 may further determine whether a difference between the shaking action start moment included in the first shaking action event and the shaking action start moment included in the second shaking action event is less than a target preset threshold. If the difference between the shaking action start moment included in the first shaking action event and the shaking action start moment included in the second shaking action event is less than the target preset threshold, the processor 401 determines that the events match, where the events occur on the terminal 400 and the wearable device within the preset time period. The terminal 400 and the wearable device are bound. When the shaking action events occur on the terminal 400 and the wearable device in the preset time period, it can indicate that the terminal 400 is in a hand of the user. This enhances headset sound channel switching security, and increases enjoyment of a user operation.

The preset time period may be five seconds, 10 seconds, 15 seconds, or the like. The preset threshold may be 0.03 second, 0.05 second, or the like. The target preset threshold may also be 0.03 second or 0.05 second. The preset threshold and the target preset threshold may be the same, or may be different. This is not limited in this embodiment of the present invention.

It can be learned that according to the terminal shown in FIG. 4, when determining the wearing mode of the headset, for example, when determining that the user reversely wears the headset, the headset sends, to the terminal by using the pre-established communication connection, the wearing mode signal that indicates the headset is reversely worn. After receiving the wearing mode signal, the terminal may output the played audio signal by means of sound channel switching, so as to implement headset sound channel switching. In this manner, the headset may detect whether the headset is reversely worn, and the terminal automatically performs sound channel switching when the headset is reversely worn. In this way, the user can implement sound channel switching without transposing left and right earpieces of the headset, thereby improving headset sound channel switching efficiency. Further, after receiving the wearing mode signal indicating that the headset is reversely worn, the terminal may prompt the user to determine whether to perform automatic sound channel switching or manual sound channel switching, thereby improving headset sound channel switching flexibility.

Figure 6:
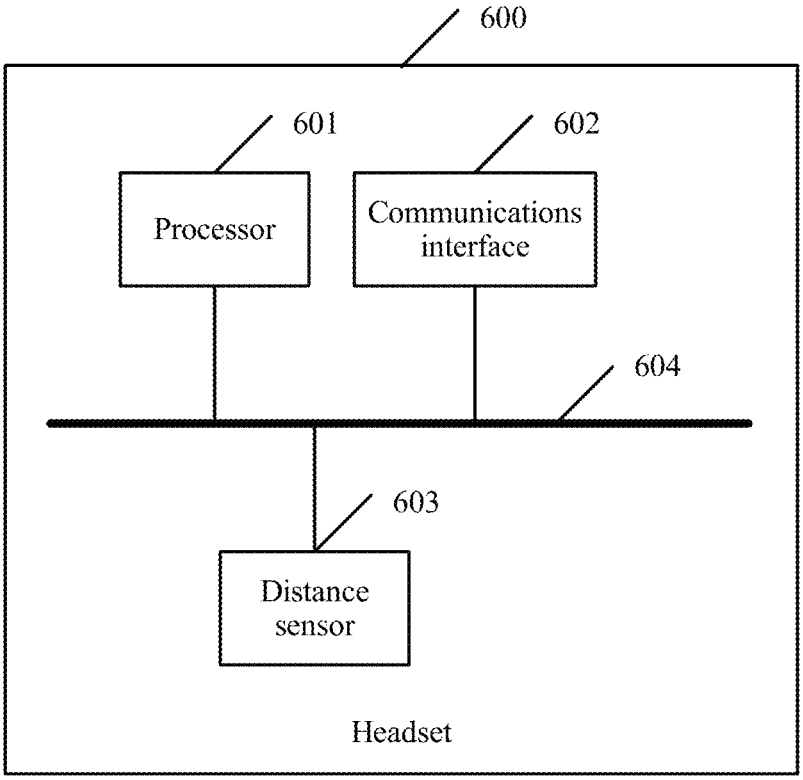
FIG. 6 is a schematic structural diagram of a headset according to an embodiment of the present invention.

Based on the scenario shown in FIG. 1, an embodiment of the present invention discloses a headset. Referring to FIG. 6, FIG. 6 is a schematic structural diagram of a headset according to an embodiment of the present invention. A headset 600 shown in FIG. 6 pre-establishes a communication connection to a terminal. As shown in FIG. 6, the headset 600 may include a processor 601, a communications interface 602, a distance sensor 603, and a communications bus 604.

Distance sensors 603 are separately disposed on a same side of left and right earpieces of the headset 600 when the left and right earpieces of the headset 600 are placed facing each other, and are configured to detect a distance between the headset 600 and an obstacle (the obstacle may be an auricle, or may be another object such as hairs in the front of an ear of a user, or a mobile phone).

The communications bus 604 may implement a communication connection between these components including the processor 601, the communications interface 602, and the distance sensor 603.

The processor 601 may determine a wearing mode of the headset 600, and generate a wearing mode signal, and the communications interface 602 may send the wearing mode signal to the terminal by using the communication connection pre-established between the terminal and the headset 600.

In this embodiment of the present invention, the headset 600 and the terminal establish the communication connection in two manners. One is a wired connection, that is, the headset 600 and the terminal establish the connection by plugging a headset plug into a headset socket of the terminal. In this case, the communications interface 602 is the headset plug. The other is a wireless connection, that is, the headset and the terminal establish the connection by means of Bluetooth. In this case, the communications interface 602 is a Bluetooth transceiver of the headset 600. The processor 601 may determine the wearing mode of the headset 600, and generate the wearing mode signal according to the wearing mode, and the communications interface 602 sends the wearing mode signal to the terminal. The wearing mode includes a reverse headset wearing mode and a correct headset wearing mode. The wearing mode signal is used to indicate that the headset is reversely worn or the headset is correctly worn.

Specifically, the headset 600 includes a left earpiece and a right earpiece. The distance sensors 603 are separately disposed on opposite positions of the left and right earpieces. The distance sensors 603 may be disposed on a same side of the left and right earpieces when the left and right earpieces are disposed facing each other. As shown in FIG. 3, the distance sensor may be disposed on an external side of the earpiece, or may be disposed on an internal side of the earpiece. This is not limited in this embodiment of the present invention. Therefore, the distance sensors 603 on the left and right earpieces of the headset 600 may determine the wearing mode of the headset by detecting a distance between an earpiece and an auricle.

In specific implementation, the distance sensor 603 may detect distances between the left and right earpieces of the headset 600 and obstacles. A main manner in which the processor 601 determines the wearing mode of the headset 600 may be as follows:

The distance sensor 603 detects a distance between a headset earpiece and an obstacle, and sends the distance to the processor 601. The processor 601 determines whether the distance falls within a preset distance threshold; and when the distance falls beyond the preset distance threshold, determines that the wearing mode of the headset 600 is the reverse headset wearing mode; or when the distance falls within the preset distance threshold, determines that the wearing mode of the headset 600 is the correct headset wearing mode.

A specific manner in which the communications interface 602 sends the wearing mode signal to the terminal by using the communication connection may be as follows:

Manner 1:

When the communication connection is a wired connection, and the wired connection includes an audio input channel between the headset 600 and the terminal, the communications interface 602 sends the wearing mode signal to the terminal by using the audio input channel, where the wearing mode signal is a carrier signal; the carrier signal may be a specified carrier signal, such as a modulated carrier in a specified frequency or a carrier signal in a specified waveform; and the carrier signal may be used to indicate at least one of the following: the headset is reversely worn or the headset is correctly worn.

Manner 2:

When the communication connection is a wireless connection (for example, a Bluetooth connection), the communications interface 602 sends the wearing mode signal to the terminal by using the wireless connection, where the wearing mode signal is an extended code.

It can be learned that according to the headset shown in FIG. 6, the headset may detect the wearing mode of the headset, and generate the wearing mode signal, so as to notify the terminal of a wearing status of the headset, so that the terminal can control sound channel output of a played audio signal according to the wearing mode signal. That is, the terminal may automatically control sound channel output of the left and right earpieces of the headset when the headset is reversely worn, and the user does not need to transpose wearing positions of the headset earpieces, so that headset sound channel switching efficiency can be improved.

Figure 7:
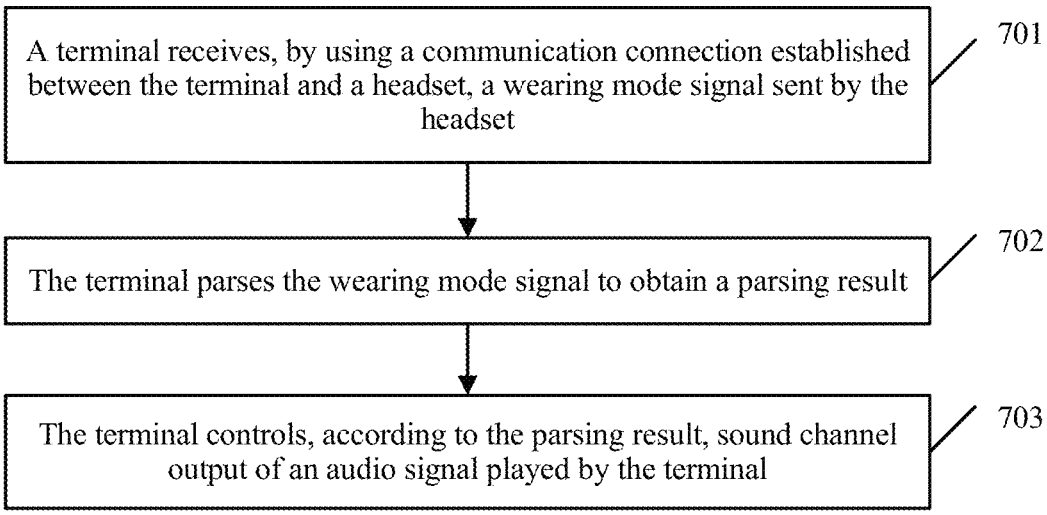
FIG. 7 is a schematic flowchart of another headset sound channel control method according to an embodiment of the present invention.

Based on the scenario shown in FIG. 1, an embodiment of the present invention discloses another headset sound channel control method. Referring to FIG. 7, FIG. 7 is a schematic flowchart of another headset sound channel control method according to an embodiment of the present invention. The method in FIG. 7 may be applied to the terminal 400 shown in FIG. 4. The terminal pre-establishes a communication connection to a headset. As shown in FIG. 7, the headset sound channel control method may include the following steps.

701. The terminal receives, by using a communication connection established between the terminal and the headset, a wearing mode signal sent by the headset.

The wearing mode signal is used to indicate that the headset is reversely worn or the headset is correctly worn.

702. The terminal parses the wearing mode signal to obtain a parsing result.

703. The terminal controls, according to the parsing result, sound channel output of an audio signal played by the terminal.

If the wearing mode signal is used to indicate that the headset is reversely worn, the terminal finally outputs, by means of sound channel switching, the audio signal played by the terminal; or if the wearing mode signal is used to indicate that the headset is correctly worn, the terminal may not make any change to a current sound channel output manner.

It can be learned that in the method shown in FIG. 7, the terminal may control a sound channel output manner of left and right earpieces of the headset according to a wearing mode (a reverse wearing mode or a correct wearing mode) of the headset. That is, the terminal may automatically control sound channel output of the left and right earpieces of the headset when the headset is reversely worn, and a user does not need to transpose wearing positions of the headset earpieces, so that headset sound channel switching efficiency can be improved.

Figure 8:
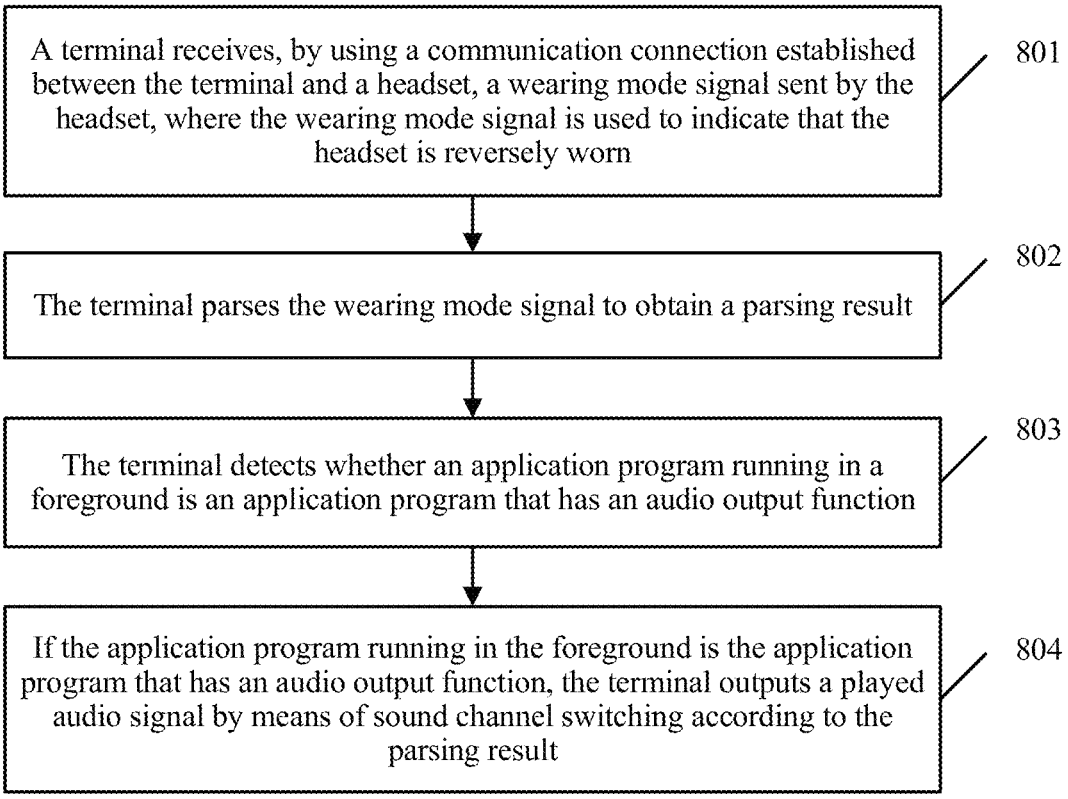
FIG. 8 is a schematic flowchart of still another headset sound channel control method according to an embodiment of the present invention.

Based on the scenario shown in FIG. 1, an embodiment of the present invention discloses still another headset sound channel control method. Referring to FIG. 8, FIG. 8 is a schematic flowchart of still another headset sound channel control method according to an embodiment of the present invention. The method in FIG. 8 may be applied to the terminal 400 shown in FIG. 4. The terminal pre-establishes a communication connection to a headset. As shown in FIG. 8, the headset sound channel control method may include the following steps.

801. The terminal receives, by using a communication connection established between the terminal and the headset, a wearing mode signal sent by the headset.

The wearing mode signal is used to indicate that the headset is reversely worn.

802. The terminal parses the wearing mode signal to obtain a parsing result.

The parsing result indicates that the headset is reversely worn.

803. The terminal detects whether an application program running in a foreground is an application program that has an audio output function.

The application program that has an audio output function may include but is not limited to at least one of a music player, a video player, a call application, or a game application.

804. If the application program running in the foreground is the application program that has an audio output function, the terminal outputs a played audio signal by means of sound channel switching according to the parsing result.

It can be learned that in the method shown in FIG. 8, the terminal performs headset sound channel switching only when the headset is reversely worn and the application program running in the foreground is the application program that has an audio output function. This can avoid unnecessary sound channel switching, and improve sound channel switching accuracy.

Figure 9:
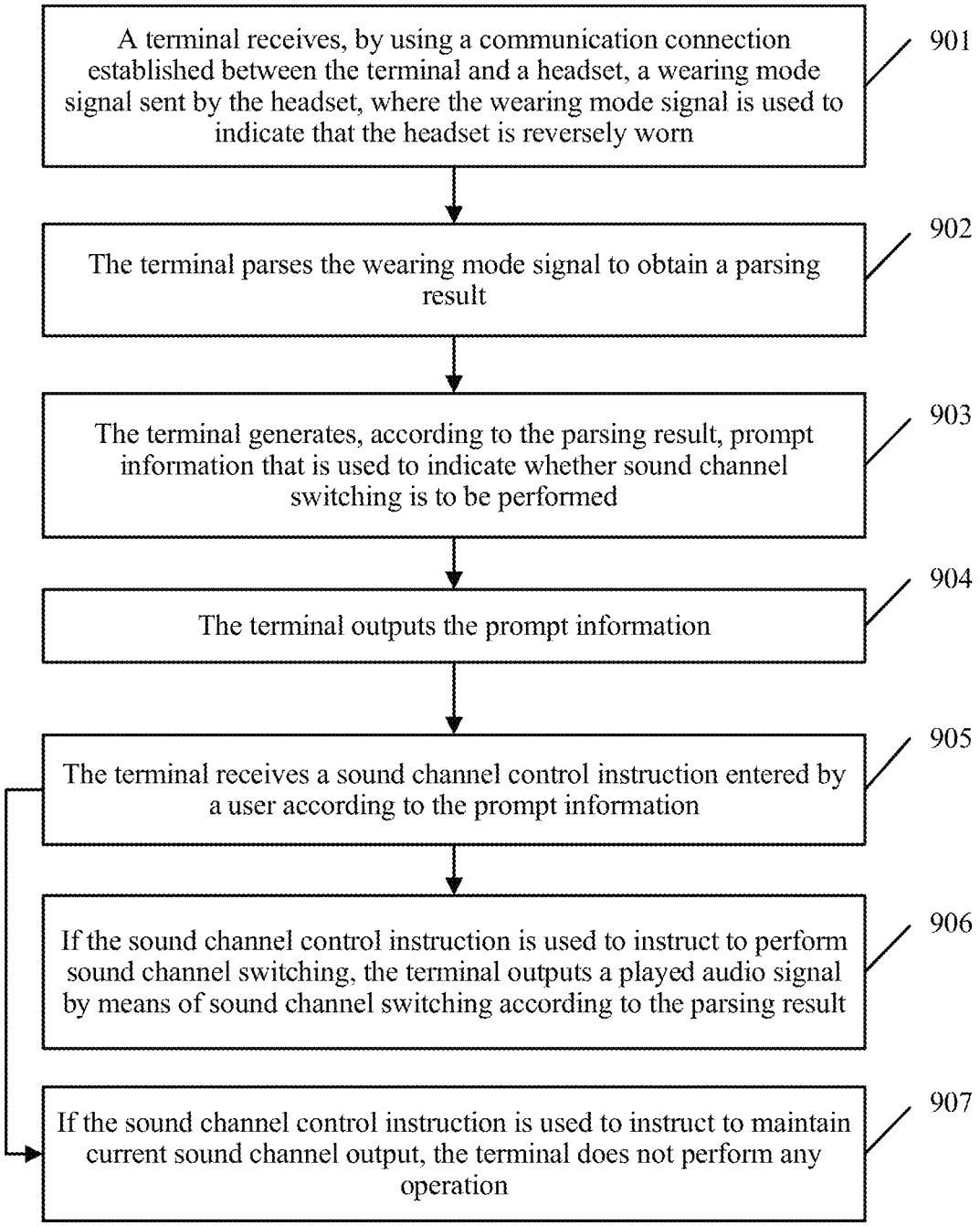
FIG. 9 is a schematic flowchart of still another headset sound channel control method according to an embodiment of the present invention.

Based on the scenario shown in FIG. 1, an embodiment of the present invention discloses still another headset sound channel control method. Referring to FIG. 9, FIG. 9 is a schematic flowchart of still another headset sound channel control method according to an embodiment of the present invention. The method in FIG. 9 may be applied to the terminal 400 shown in FIG. 4. The terminal pre-establishes a communication connection to a headset. As shown in FIG. 9, the headset sound channel control method may include the following steps.

901. The terminal receives, by using a communication connection established between the terminal and the headset, a wearing mode signal sent by the headset.

The wearing mode signal is used to indicate that the headset is reversely worn.

902. The terminal parses the wearing mode signal to obtain a parsing result.

The parsing result indicates that the headset is reversely worn.

903. The terminal generates, according to the parsing result, prompt information that is used to indicate whether sound channel switching is to be performed.

904. The terminal outputs the prompt information.

The terminal may output a text prompt on a screen of the terminal, may output a voice prompt by using the headset, or may output a text prompt on a screen of a wearable device bound to the terminal. This is not limited in this embodiment of the present invention.

905. The terminal receives a sound channel control instruction selected by a user according to the prompt information.

906. If the sound channel control instruction is used to instruct to perform sound channel switching, the terminal outputs a played audio signal by means of sound channel switching according to the parsing result.

907. If the sound channel control instruction is used to instruct to maintain current sound channel output, the terminal does not perform any operation.

It can be learned that in the method shown in FIG. 9, after receiving the wearing mode signal indicating that the headset is reversely worn, the terminal may prompt the user to determine whether to perform automatic sound channel switching or manual switching, thereby improving sound channel switching flexibility.

Figure 10:
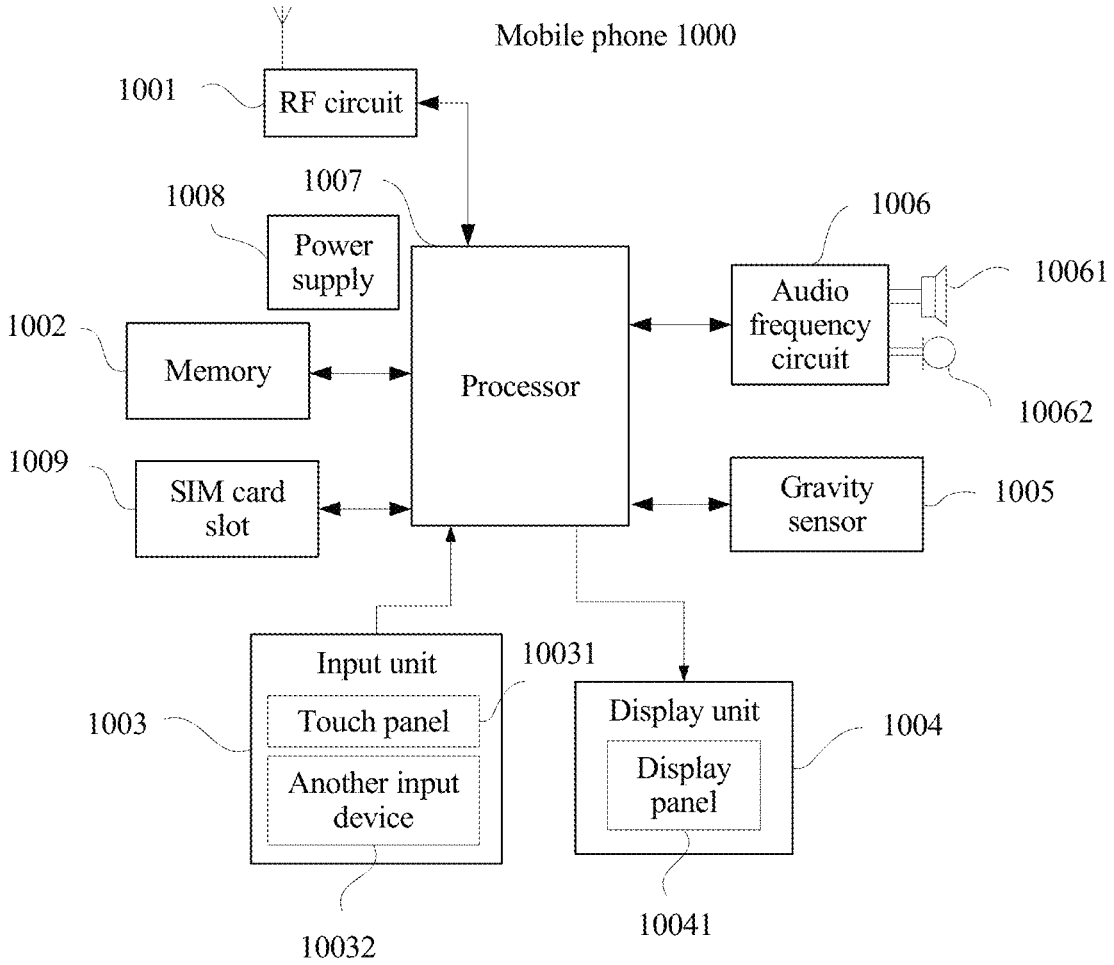
FIG. 10 is a schematic structural diagram of a terminal according to an embodiment of the present invention.

Based on the scenario shown in FIG. 1, an embodiment of the present invention discloses a terminal. Referring to FIG. 10, FIG. 10 is a schematic structural diagram of a terminal according to an embodiment of the present invention. The terminal provided in this embodiment of the present invention may be configured to perform the methods implemented in the embodiments of the present invention shown in FIG. 7 to FIG. 9. For ease of description, only a part related to this embodiment of the present invention is shown.

The terminal may be a terminal device such as a mobile phone, a tablet computer, a notebook computer, a UMPC (Ultra-mobile Personal Computer, ultra-mobile personal computer), a netbook, or a PDA (Personal Digital Assistant, personal digital assistant). In this embodiment of the present invention, an example in which the terminal is a mobile phone is used for description. FIG. 10 shows a block diagram of a partial structure of a mobile phone 1000 related to this embodiment of the present invention.

As shown in FIG. 10, the mobile phone 1000 includes components such as an RF (radio frequency, radio frequency) circuit 1001, a memory 1002, an input unit 1003, a display unit 1004, a gravity sensor 1005, an audio frequency circuit 1006, a processor 1007, a power supply 1008, and a subscriber identity module (Subscriber Identity Module, SIM) card slot 1009. A person skilled in the art may understand that the structure of the mobile phone shown in FIG. 10 constitutes no limitation on the mobile phone, and the mobile phone may include components more or fewer than those shown in the diagram, or a combination of some components, or different component arrangements.

With reference to FIG. 10, the following provides detailed description of all the components of the mobile phone 1000.

The RF circuit 1001 may be configured to receive and send information, or to receive and send a signal in a call process. Particularly, after receiving downlink information of a base station, the RF circuit 1001 sends the downlink information to the processor 1007 for processing, and sends uplink data to the base station. Generally, the RF circuit includes but is not limited to an antenna, at least one amplifier, a transceiver, a coupler, an LNA (Low Noise Amplifier, low noise amplifier), a duplexer, or the like. In addition, the RF circuit 1001 may further communicate with a network and another device by means of wireless communication. Any communications standard or protocol may be used for the wireless communication, including but not limited to GSM (Global System of Mobile communication, Global System for Mobile Communications), GPRS (General Packet Radio Service, general packet radio service), CDMA (Code Division Multiple Access, Code Division Multiple Access), WCDMA (Wideband Code Division Multiple Access, Wideband Code Division Multiple Access), LTE (Long Term Evolution, Long Term Evolution), an email, an SMS (Short Messaging Service, short message service), and the like.

The memory 1002 may be configured to store a software program and a module, and the processor 1007 runs the software program and the module stored in the memory 1002, so as to execute various functional applications of the mobile phone 1000 and perform data processing. The memory 1002 may mainly include a program storage area and a data storage area. The program storage area may store an operating system, an application required by at least one function (such as an audio play function or a video play function), and the like, and the data storage area may store data (such as audio data, video data, or a phonebook) created according to use of the mobile phone 1000, and the like. In addition, the memory 1002 may include a high-speed random access memory, and may further include a nonvolatile memory, such as at least one magnetic disk storage component, a flash memory component, or another volatile solid-state storage component.

The input unit 1003 may be configured to: receive entered digital or character information, and generate key signal input related to a user setting and function control of the mobile phone 1000. Specifically, the input unit 340 may include a touch panel 10031 and another input device 10032. The touch panel 10031 is also referred to as a touchscreen, and may collect a touch operation performed by a user on or near the touch panel 10031 (such as an operation performed by the user on the touch panel 10031 or near the touch panel 10031 by using any proper object or accessory, such as a finger or a stylus), and drive a corresponding connection apparatus according to a preset program. Optionally, the touch panel 10031 may include two parts: a touch detection apparatus and a touch controller. The touch detection apparatus detects a touch position of the user, detects a signal brought by the touch operation, and sends the signal to the touch controller. The touch controller receives touch information from the touch detection apparatus, converts the touch information into touch point coordinates, and sends the touch point coordinates to the processor 1007; and can receive and execute a command sent by the processor 380. In addition, the touch panel 10031 may be, for example, a resistive, capacitive, infrared, or surface acoustic touch panel. The input unit 1003 may include the another input device 10032 in addition to the touch panel 10031. Specifically, the another input device 10032 may include but is not limited to one or more of a physical keyboard, a function key (such as a volume control key or a power switch key), a trackball, a mouse, an operating lever, or the like.

The display unit 1004 may be configured to display information entered by the user or information provided for the user, and various menus of the mobile phone 1000. The display unit 1004 may include a display panel 10041. Optionally, the display panel 10041 may be configured by using an LCD (Liquid Crystal Display, liquid crystal display), an OLED (Organic Light-Emitting Diode, organic light-emitting diode), or the like. Further, the touch panel 10031 may cover the display panel 10041. When detecting a touch operation on or near the touch panel 10031, the touch panel 10031 transmits the touch operation to the processor 1007 to determine a type of a touch event, and then the processor 1007 provides corresponding visual output on the display panel 10041 according to the type of the touch event. Although the touch panel 10031 and the display panel 10041 are used as two independent components in FIG. 10 to implement input and input functions of the mobile phone 1000, in some embodiments, the touch panel 10031 and the display panel 10041 may be integrated to implement the input and output functions of the mobile phone 1000.

The gravity sensor (Gravity Sensor) 1005 may detect acceleration values in all directions (generally, three axes) of the mobile phone, may detect a value and a direction of gravity in a static mode, and may be applied to an application for identifying a placement manner (such as switching between landscape and portrait screens, a relevant game, and magnetometer gesture calibration) of the mobile phone, a function related to vibration identification (such as a pedometer or a stroke), and the like.

The mobile phone 1000 may further include another sensor, such as a light sensor. Specifically, the light sensor may include an ambient light sensor and a proximity light sensor. The ambient light sensor may adjust luminance of the display panel 10041 according to brightness of ambient light, and the proximity light sensor may detect whether an object is close to or is in contact with the mobile phone, and may close the display panel 10041 and/or backlight when the mobile phone 1000 approaches an ear. Other sensors such as a gyroscope, a barometer, a hygrometer, a thermometer, and an infrared sensor may be disposed on the mobile phone 300. Details are not described herein.

The audio frequency circuit 1006, a speaker 10061, and a microphone 10062 may provide an audio interface between the user and the mobile phone 1000. The audio frequency circuit 1006 may convert received audio data into an electrical signal, and transmit the electrical signal to the speaker 10061, and the speaker 10061 converts the electrical signal into a sound signal for output. In addition, the microphone 10062 converts a collected sound signal into an electrical signal, and the audio circuit 1006 receives the electrical signal, converts the electrical signal into audio data, and outputs the audio data to the RF circuit 1001, so as to send the audio data to, for example, another mobile phone, or output the audio data to the memory 1002 for further processing.

The processor 1007 is a control center of the mobile phone 1000, and uses various interfaces and lines to connect all parts of the entire mobile phone. The processor 1001 executes various functions of the mobile phone 1000 and performs data processing by running or executing the software program and/or the module stored in the memory 1001 and by invoking data stored in the memory 1002, so as to perform overall monitoring on the mobile phone. Optionally, the processor 1007 may include one or more processing units. Preferably, an application processor and a modem processor may be integrated into the processor 1007. The application processor mainly processes an operating system, a user interface, an application program, and the like, and the modem processor mainly processes wireless communication. It can be understood that, the modem processor may not be integrated into the processor 1007.

The mobile phone 1000 further includes the power supply 1008 (such as a battery) for supplying power to each component. Preferably, the power supply may be logically connected to the processor 1007 by using a power management system, so as to implement functions such as charging management, discharging management, and power consumption management by using the power management system.

The mobile phone 1000 may further include a SIM card slot for accommodating a SIM card, so that the user can make a call or answer a call by using the mobile phone.

Although not shown, the mobile phone 1000 may further include a Wi-Fi (Wireless Fidelity, Wireless Fidelity) module, a Bluetooth module, and the like. Details are not described herein.

In this embodiment of the present invention, the RF circuit may further receive a wearing mode signal sent by a headset by using a communication connection established between the terminal and the headset. The processor may further parse the wearing mode signal, and output a played audio signal by means of sound channel switching according to a parsing result.

In this embodiment of the present invention, after receiving the parsing result that is obtained by parsing the wearing mode signal and that indicates that the headset is reversely worn, the processor 1007 may control the display unit 1004 to display, to the user, prompt information indicating that the headset is reversely worn and whether sound channel switching is to be performed. The user may input, by using the input unit 1003, a sound channel control instruction instructing whether to choose to perform sound channel switching, so as to instruct the processor 1007 whether to perform sound channel switching processing.

In this embodiment of the present invention, the Bluetooth module may further send a voice prompt to the headset by using a Bluetooth connection established between the terminal and the headset, so as to prompt the user whether to perform sound channel switching.

Figure 11:
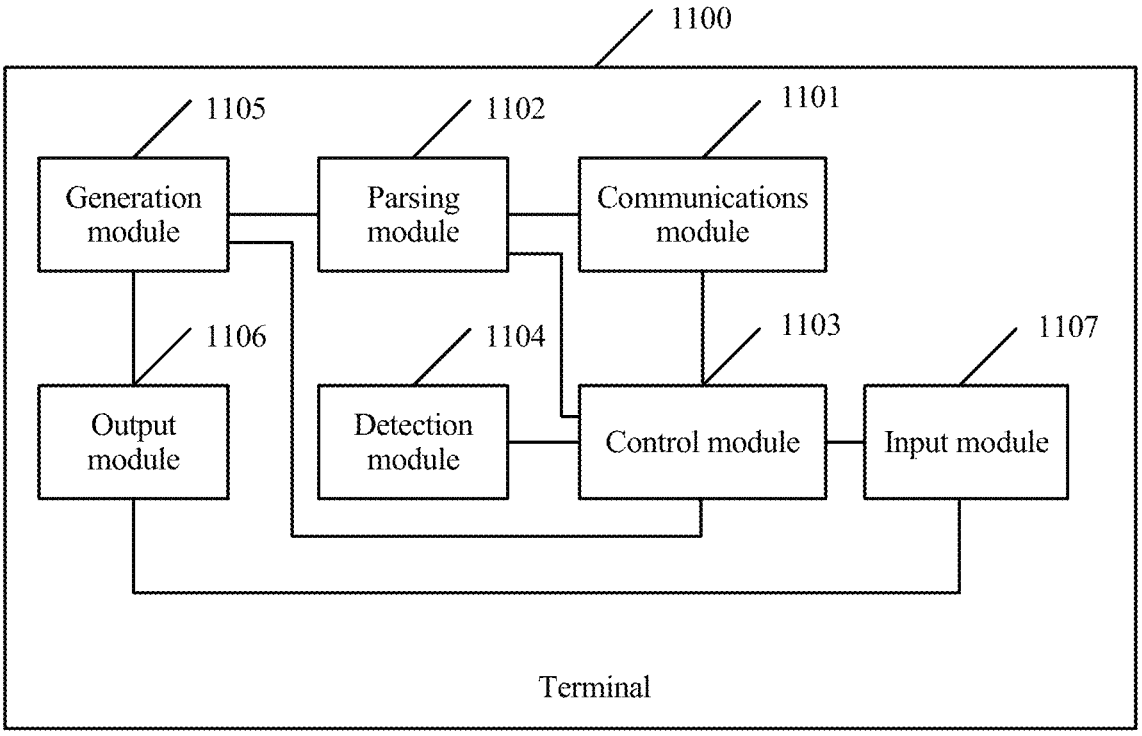
FIG. 11 is a schematic structural diagram of another terminal according to an embodiment of the present invention.

Based on the scenario shown in FIG. 1, an embodiment of the present invention discloses a terminal. Referring to FIG. 11, FIG. 11 is a schematic structural diagram of a terminal according to an embodiment of the present invention. A terminal 1100 in FIG. 11 pre-establishes a communication connection to a headset. As shown in FIG. 10, the terminal 1100 may include a communications module 1101, a parsing module 1102, and a control module 1103.

The communications module 1101 may receive, by using the communication connection established between the terminal 1100 and the headset, a wearing mode signal sent by the headset, where the wearing mode signal is used to indicate that the headset is reversely worn or the headset is correctly worn.

The parsing module 1102 may parse the wearing mode signal received by the communications module, to obtain a parsing result.

The control module 1103 may control, according to the parsing result obtained by the parsing module, sound channel output of an audio signal played by the terminal 1100.

In an implementation, the terminal 1100 may further include a detection module 1104.

When the parsing module 1102 parses the wearing mode signal to obtain the parsing result, and the parsing result is that the headset is reversely worn, the detection module 1104 may detect whether an application program running in a foreground is an application program that has an audio output function. If the detection module 1104 detects that the application program running in the foreground is the application program that has an audio output function, the control module 1103 is triggered to output, by means of sound channel switching according to the parsing result, the audio signal played by the terminal 1100.

The control module 1103 performs headset sound channel switching only when the headset is reversely worn and the application program running in the foreground is a specified application program. This can avoid unnecessary sound channel switching, and improve sound channel switching accuracy.

In another implementation, the terminal 1100 may further include a generation module 1105, an output module 1106, and an input module 1107.

The generation module 1105 may generate, according to the parsing result obtained by the parsing module 1102, prompt information that is used to indicate whether sound channel switching is to be performed.

The output module 1106 may output the prompt information generated by the generation module 1105.

The prompt information may be a voice prompt or a text prompt. This is not limited in this embodiment of the present invention.

After the output module 1106 outputs the prompt information, the input module 1107 may receive a sound channel control instruction entered by a user according to the prompt information. The sound channel control instruction may be used to instruct to perform sound channel switching, or may be used to instruct to maintain current sound channel output.

In this case, when the input module 1107 receives a sound channel control instruction that is used to instruct to perform sound channel switching, and the parsing result is that the headset is reversely worn, the control module 1103 may output, by means of sound channel switching, the audio signal played by the terminal 1100.

In addition, a specific manner of generating the sound channel control instruction may be as follows:

The detection module 1104 detects whether a placement manner of the terminal 1100 changes within a preset time period after the output module 1106 outputs the prompt information. If the placement manner of the terminal 1100 changes, the generation module 1105 generates a sound channel control instruction that is used to instruct to perform sound channel switching; or if the placement manner of the terminal 1100 does not change, the generation module 1105 generates a sound channel control instruction that is used to instruct to maintain current sound channel output. The control module 1103 controls the sound channel output of the played audio signal according to the sound channel control instruction generated by the generation module 1105. The placement manner may include facing up, placing on one side, facing down, or the like.

When the headset is reversely worn, the user may perform sound channel switching by changing the placement manner of the terminal 1100, thereby improving sound channel switching efficiency, enhancing user engagement, and increasing enjoyment.

In this embodiment of the present invention, the communications module 1101 may further receive a sound channel control instruction sent by a wearable device bound to the terminal 1100.

It is detected whether the sound channel control instruction sent by the wearable device is received by the communications module 1101 within a preset time period after the output module 1106 outputs the prompt information. If the sound channel control instruction sent by the wearable device is not received by the communications module 1101, the generation module 1105 generates a sound channel control instruction according to the prompt information; or if the sound channel control instruction sent by the wearable device is received by the communications module 1101, and the sound channel control instruction is used to instruct to perform sound channel switching, the control module 1103 outputs, by means of sound channel switching, the audio signal played by the terminal 1100.

When the headset is reversely worn, the user may perform headset sound channel switching by using the wearable device, and automatically control sound channel output when no sound channel control instruction is received from the wearable device within a long time. This can not only improve headset sound channel control efficiency, but also increase enjoyment and convenience of a user operation.

It should be noted that, a function of the communications module 1101 may be integrated into a communications interface. The communications interface may include a receiver and a transmitter. Functions of the parsing module 1102, the processing module 1103, the detection module 1104, and the generation module 1105 may be integrated into a processor. The output module 1106 may be integrated into an output device, and the input module 1107 may be integrated into an input device. In addition, an input device may include a receiver, and an output device may include a transmitter. This is not limited in this embodiment of the present invention.

It can be learned that according to the terminal shown in FIG. 11, when the headset detects a wearing mode of the headset, for example, the user reversely wears the headset, the headset sends, to the terminal by using the pre-established communication connection, the wearing mode signal that indicates the headset is reversely worn. After receiving the wearing mode signal and parsing the wearing mode signal to obtain the parsing result, the terminal may output the played audio signal by means of sound channel switching, so as to implement headset sound channel switching. In this manner, the headset may detect whether the headset is reversely worn, and the terminal automatically performs sound channel switching when the headset is reversely worn. In this way, the user can implement sound channel switching without transposing left and right earpieces of the headset, thereby improving headset sound channel switching efficiency. Further, after receiving the wearing mode signal indicating that the headset is reversely worn, the terminal may prompt the user to determine whether to perform automatic sound channel switching or manual sound channel switching, thereby improving headset sound channel switching flexibility.

Figure 12:
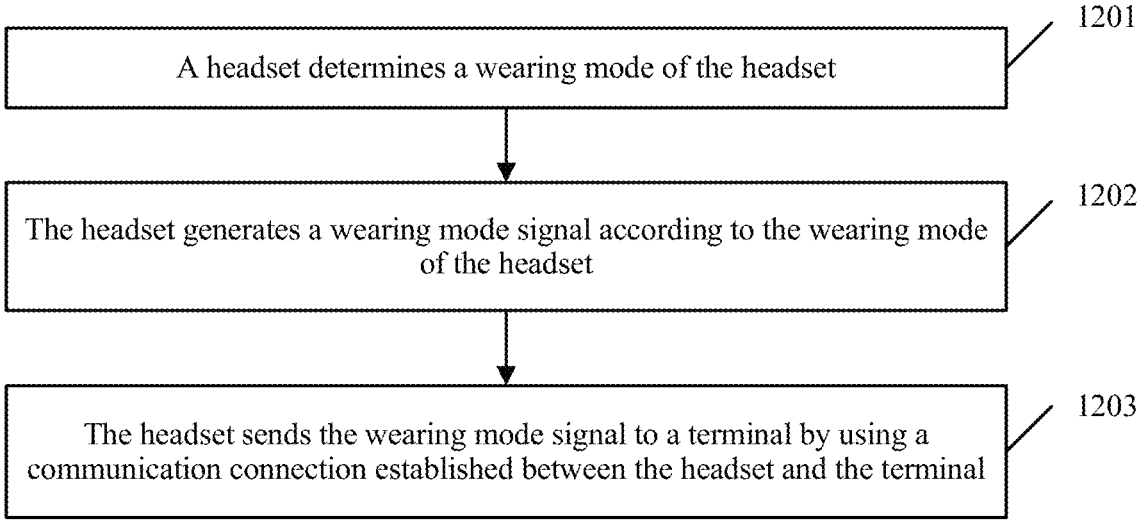
FIG. 12 is a schematic flowchart of still another headset sound channel control method according to an embodiment of the present invention.

Based on the scenario shown in FIG. 1, an embodiment of the present invention discloses still another headset sound channel control method. Referring to FIG. 12, FIG. 12 is a schematic flowchart of still another headset sound channel control method according to an embodiment of the present invention. The method shown in FIG. 12 may be applied to a headset. The headset pre-establishes a communication connection to a terminal. As shown in FIG. 12, the method may include the following steps.

1201. The headset detects a wearing mode of the headset.

1202. The headset generates a wearing mode signal according to the wearing mode of the headset.

If a detection result is that the headset is in a reverse headset wearing mode, the wearing mode signal is used to indicate that the headset is reversely worn; or if a detection result is that the headset is in a correct headset wearing mode, the wearing mode signal is used to indicate that the headset is correctly worn.

1203. The headset sends the wearing mode signal to the terminal by using a communication connection established between the headset and the terminal.

It can be learned that in the method shown in FIG. 12, the headset may determine the wearing mode of the headset, and generate the wearing mode signal, so as to notify the terminal of a wearing status of the headset, so that the terminal can control sound channel output of a played audio signal according to the wearing mode signal. That is, the terminal may automatically control sound channel output of left and right earpieces of the headset when the headset is reversely worn, and a user does not need to transpose wearing positions of the headset earpieces, so that headset sound channel switching efficiency can be improved.

Figure 13:
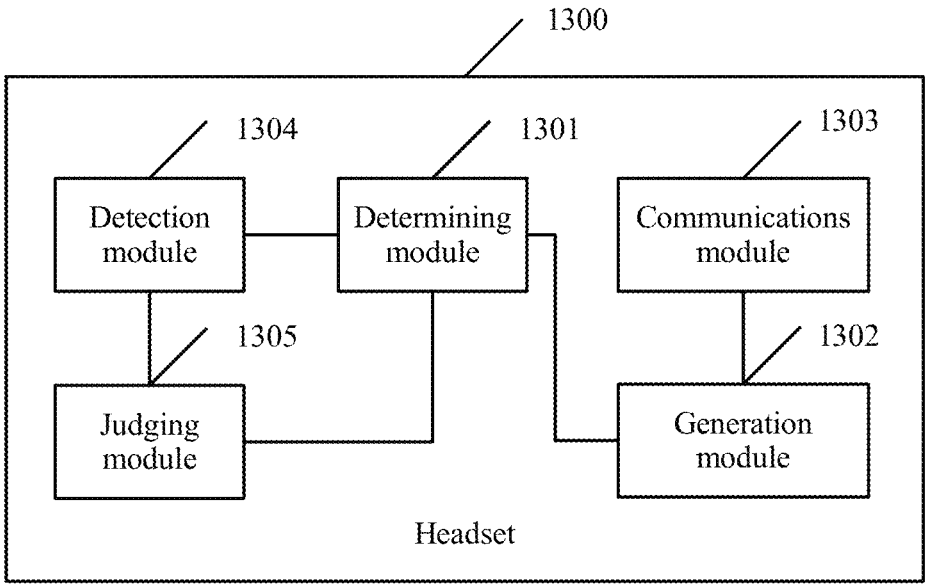
FIG. 13 is a schematic structural diagram of a headset according to an embodiment of the present invention.

Based on the scenario shown in FIG. 1, an embodiment of the present invention discloses a headset. Referring to FIG. 13, FIG. 13 is a schematic structural diagram of a headset according to an embodiment of the present invention. A headset 1300 shown in FIG. 13 pre-establishes a communication connection to a terminal. As shown in FIG. 13, the headset 1300 may include a determining module 1301, a generation module 1302, and a communications module 1303.

The determining module 1301 may determine a wearing mode of the headset 1300, where the wearing mode may include a reverse headset wearing mode and a correct headset wearing mode.

The generation module 1302 may generate a wearing mode signal according to a result of the determining of the determining module 1301.

If the result of the determining is that the headset is in the reverse headset wearing mode, the wearing mode signal is used to indicate that the headset is reversely worn; or if the result of the determining is that the headset is in the correct headset wearing mode, the wearing mode signal is used to indicate that the headset is correctly worn.

The communications module 1303 may send the wearing mode signal to the terminal by using the communication connection established between the headset and the terminal.

In specific implementation, the headset 1300 may further include a detection module 1304 and a judging module 1305.

The determining module 1301 may determine whether the headset 1300 is in a wearing state. When the determining module 1301 determines that the headset 1300 is in a wearing state, the detection module 1304 may detect a distance between the headset 1300 and an obstacle, and send the distance to the judging module 1305. The judging module 1305 may determine whether the distance falls within a preset distance threshold. If the distance falls beyond the preset distance threshold, the determining module 1301 determines that the wearing mode of the headset 1300 is the reverse headset wearing mode; or if the distance falls within the preset distance threshold, the determining module 1301 determines that the wearing mode of the headset 1300 is the correct headset wearing mode.

It can be learned that according to the headset shown in FIG. 13, the headset may determine the wearing mode of the headset, and generate the wearing mode signal, so as to notify the terminal of the wearing mode of the headset, so that the terminal can control sound channel output of a played audio signal according to the wearing mode signal. That is, the terminal may automatically control sound channel output of left and right earpieces of the headset when the headset is reversely worn, and a user does not need to transpose wearing positions of the headset earpieces, so that headset sound channel switching efficiency can be improved.

Figure 14:
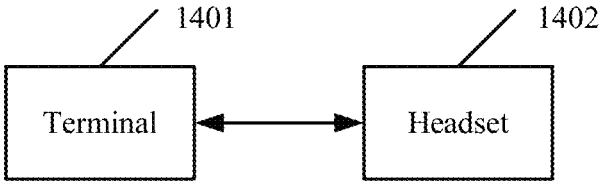
FIG. 14 is a schematic structural diagram of a headset sound channel control system according to an embodiment of the present invention.

Referring to FIG. 14, FIG. 14 is a schematic structural diagram of a headset sound channel control system according to an embodiment of the present invention. As shown in FIG. 14, the system shown in FIG. 14 may include a terminal 1401 and a headset 1402. The terminal 1401 and the headset 1402 pre-establish a communication connection.

The headset 1402 is configured to: determine a wearing mode of the headset 1042, generate a wearing mode signal according to the wearing mode of the headset 1402, and send the wearing mode signal to the terminal 1401 by using the communication connection. The wearing mode includes a reverse headset wearing mode and a correct headset wearing mode. The wearing mode signal may be used to indicate that the headset 1402 is reversely worn, or may be used to indicate that the headset 1402 is correctly worn.

After receiving, by using the communication connection, the wearing mode signal sent by the headset 1402, the terminal 1401 may parse the wearing mode signal to obtain a parsing result, and control, according to the parsing result, sound channel output of an audio signal played by the terminal 1401.

It can be learned that in the system shown in FIG. 14, the headset may detect the wearing mode of the headset, generate the wearing mode signal, and send the signal to the terminal, so that after paring the wearing mode signal to obtain the parsing result, the terminal can control, according to the parsing result, that is, the wearing mode (the reverse wearing mode or the correct wearing mode) of the headset, the sound channel output of the audio signal played by the terminal. In this manner, the headset may detect whether the headset is reversely worn, and the terminal automatically performs sound channel switching when the headset is reversely worn. In this way, a user can implement sound channel switching without transposing left and right earpieces of the headset, thereby improving headset sound channel switching efficiency.

It should be noted that, in the foregoing embodiments, the descriptions of the embodiments have their respective focuses. For a part that is not described in detail in an embodiment, refer to related descriptions in other embodiments. In addition, a person skilled in the art should also appreciate that all the embodiments described in this specification are examples, and the related actions and modules are not necessarily mandatory to the present invention.

A sequence of the steps of the method in the embodiments of the present invention may be adjusted, and some steps may also be merged or removed according to an actual requirement.

The modules in the terminal and the headset in the embodiments of the present invention may be combined, divided, and deleted according to an actual requirement.

The modules in the embodiments of the present invention may be implemented by using a universal integrated circuit, such as a CPU (Central Processing Unit, central processing unit), or by using an ASIC (Application Specific Integrated Circuit, application-specific integrated circuit).

A person of ordinary skill in the art may understand that all or a part of the processes of the methods in the embodiments may be implemented by a computer program instructing relevant hardware. The program may be stored in a computer readable storage medium. When the program runs, the processes of the methods in the embodiments are performed. The storage medium may be a magnetic disk, an optical disk, a ROM/RAM, or the like.

The headset sound channel control method and system, and the related device disclosed in the embodiments of the present invention are described in detail above. Principles and implementations of the present invention are described herein by using specific examples. The description of the foregoing embodiments is merely provided to help understand the present invention and core ideas of the present invention. In addition, a person of ordinary skill in the art can make variations and modifications to the present invention in terms of the specific implementations and application scopes according to the ideas of the present invention. Therefore, the content of specification shall not be construed as a limit to the present invention.

What is claimed is:

1. A terminal comprising:

a communications interface configured to receive, using a communication connection, a wearing mode signal from a headset, wherein the terminal and the headset establishes the communication connection, and wherein the wearing mode signal indicates that the headset is reversely worn or the headset is correctly worn;

a microphone chip configured to parse the wearing mode signal to obtain a parsing result;

a processor coupled to the communications interface and the microphone chip, wherein the processor is configured to:

control, according to the parsing result, sound channel output of an audio signal played by the terminal; and generate, according to the parsing result, prompt information indicating whether sound channel switching is to be performed; and an input device coupled to the processor and configured to receive a sound channel control instruction from a user according to the prompt information, wherein the sound channel control instruction instructs the processor to perform sound channel switching or to maintain current sound channel output.

2. The terminal of claim 1, wherein in a manner of receiving the wearing mode signal from the headset, the communications interface is further configured to receive, using an audio input channel, the wearing mode signal from the headset when the communication connection is a wired connection and, wherein the wired connection comprises the audio input channel between the headset and the terminal, and wherein the wearing mode signal is a carrier signal.

3. The terminal of claim 1, wherein the microphone chip is further configured to send the parsing result to the processor.

4. The terminal of claim 1, wherein the terminal further comprises:

an output device coupled to the processor and configured to output the prompt information, and wherein the processor is further configured to output, by the sound channel switching according to the sound channel control instruction, the audio signal played by the terminal when the sound channel control instruction instructing to perform the sound channel switching.

5. The terminal of claim 1, wherein in a manner of receiving the wearing mode signal from the headset, the communications interface further configured to receive, using a wireless connection, the wearing mode signal from the headset when the communication connection is the wireless connection, and wherein the wearing mode signal is an extended code.

6. The terminal of claim 1, wherein the sound channel control instruction is based on a change of a placement manner of the terminal.

7. The terminal of claim 1, wherein the sound channel control instruction is based on an input on a screen of the terminal by the user.

8. The terminal of claim 1, wherein the sound channel control instruction is based on a shaking gesture to the terminal.

9. A headset comprising:

a distance sensor configured to detect a distance between the headset and an obstacle;

a processor coupled to the distance sensor and configured to:

determine a wearing mode of the headset;

generate a wearing mode signal according to the wearing mode of the headset, wherein the headset and a terminal establishes a communication connection, wherein the wearing mode comprises a reverse headset wearing mode and a correct headset wearing mode, and wherein the wearing mode signal indicates that the headset is reversely worn or the headset is correctly worn;

determine whether the distance falls within a specified distance range;

determine that the wearing mode of the headset is the reverse headset wearing mode when the distance falls beyond the specified distance range; and determine that the wearing mode of the headset is the correct headset wearing mode when the distance falls within the specified distance range; and a communications interface coupled to the processor and configured to send the wearing mode signal to the terminal.

10. The headset of claim 9, wherein the distance sensor is further configured to send the distance to the processor.

11. The headset of claim 9, wherein in a manner of sending the wearing mode signal to the terminal, the communications interface is further configured to send the wearing mode signal to the terminal using an audio input channel when the communication connection is a wired connection, wherein the wired connection comprises the audio input channel between the headset and the terminal, and wherein the wearing mode signal is a carrier signal.

12. The headset of claim 9, wherein in a manner of sending the wearing mode signal to the terminal, the communications interface is further configured to send the wearing mode signal to the terminal using a wireless connection when the communication connection is the wireless connection, and wherein the wearing mode signal is being an extended code.

13. A headset sound channel control system, comprising:

a terminal; and a headset establishing a communication connection to the terminal, wherein the headset comprises a distance sensor configured to detect a distance between the headset and an obstacle, and configured to:

determine a wearing mode of the headset;

generate a wearing mode signal according to the wearing mode of the headset;

send the wearing mode signal to the terminal using the communication connection, wherein the wearing mode comprises a reverse headset wearing mode and a correct headset wearing mode, and wherein the wearing mode signal indicates that the headset is reversely worn or the headset is correctly worn;

determine whether the distance falls within a specified distance range;

determine that the wearing mode of the headset is the reverse headset wearing mode when the distance falls beyond the specified distance range; and determine that the wearing mode of the headset is the correct headset wearing mode when the distance falls within the specified distance range, and wherein the terminal is configured to:

receive the wearing mode signal; and control, according to the wearing mode signal, sound channel output of an audio signal played by the terminal.

14. The system of claim 13, wherein in a manner of sending the wearing mode signal to the terminal, the headset is being further configured to send the wearing mode signal to the terminal using the audio input channel, and wherein the wearing mode signal is a carrier signal.

15. The system of claim 13, wherein in a manner of sending the wearing mode signal to the terminal, the headset is further configured to send the wearing mode signal to the terminal using a wireless connection when the communication connection is the wireless connection, and wherein the wearing mode signal is an extended code.

16. The system of claim 13, wherein the distance sensor is further configured to send the distance to the terminal.

17. The system of claim 13, wherein the terminal is further configured to:

parse the wearing mode signal to obtain a parsing result; and control, according to the parsing result, the sound channel output of the audio signal played by the terminal.

18. The system of claim 17, wherein the terminal is further configured to generate, according to the parsing result, prompt information indicating whether sound channel switching is to be performed.

19. The system of claim 18, wherein the terminal comprises:

an output device configured to output the prompt information; and an input device configured to receive a sound channel control instruction from a user according to the prompt information, wherein the sound channel control instruction instructs the terminal to perform the sound channel switching or maintain current sound channel output, and wherein the terminal is further configured to output, by the sound channel switching according to the sound channel control instruction and using the output device, the audio signal played by the terminal when the sound channel control instruction instructing to perform the sound channel switching.

20. The system of claim 19, wherein the sound channel control instruction is based on any one of:

a change of a placement manner of the terminal;

an input on a screen of the terminal by the user; or a shaking gesture to the terminal.

* * * * *